US010636611B2

(12) United States Patent
Nakabayashi et al.

(10) Patent No.: US 10,636,611 B2
(45) Date of Patent: Apr. 28, 2020

(54) ROTATING ANODE X-RAY TUBE

(71) Applicant: Canon Electron Tubes & Devices Co., Ltd., Otawara-shi (JP)

(72) Inventors: Hidetaka Nakabayashi, Otawara (JP); Hiroyuki Kumadaki, Otawara (JP); Hidero Anno, Otawara (JP)

(73) Assignee: Canon Electron Tubes & Devices Co., Ltd., Otawara-shi (JP)

( * ) Notice: Subject to any disclaimer, the term of this patent is extended or adjusted under 35 U.S.C. 154(b) by 441 days.

(21) Appl. No.: 15/660,310

(22) Filed: Jul. 26, 2017

(65) Prior Publication Data

US 2017/0323758 A1 Nov. 9, 2017

Related U.S. Application Data

(63) Continuation of application No. PCT/JP2016/052019, filed on Jan. 25, 2016.

(30) Foreign Application Priority Data

Jan. 27, 2015 (JP) ..... 2015-012991
Dec. 25, 2015 (JP) ..... 2015-253985

(51) Int. Cl.
*H01J 35/10* (2006.01)
*H01J 35/26* (2006.01)

(52) U.S. Cl.
CPC ..... *H01J 35/103* (2013.01); *H01J 35/101* (2013.01); *H01J 35/105* (2013.01); *H01J 35/108* (2013.01);
(Continued)

(58) Field of Classification Search
CPC ..... H01J 35/10; H01J 35/101; H01J 35/104; H01J 35/108; H01J 2235/08;
(Continued)

(56) References Cited

U.S. PATENT DOCUMENTS 3,502,926 A 3/1970 Takano
4,413,355 A 11/1983 Matsumoto
(Continued)

FOREIGN PATENT DOCUMENTS

CN 1079843 A 12/1993
JP 56-134460 10/1981
(Continued)

OTHER PUBLICATIONS

International Search Report dated Apr. 19, 2016 in PCT/JP2016/052019 filed Jan. 25, 2016 (with English Translation).
(Continued)

*Primary Examiner* — Anastasia Midkiff
(74) *Attorney, Agent, or Firm* — Oblon, McClelland, Maier & Neustadt, L.L.P.

(57) ABSTRACT

According to one embodiment, a rotating anode X-ray tube including a rotating cylinder, a rotating shaft fixed to the inside of the rotating cylinder, an anode fixing body arranged between the rotating cylinder and the rotating shaft, extending in the axial direction, and constituted of one of a magnetic substance member formed of a magnetic substance and a heat-transfer enhancing member heat conductivity of which is higher than surrounding members, ball bearings, and an inner member, connected to the anode fixing body by a connecting member, and constituted of one of the magnetic substance member and the heat-transfer enhancing member, one being different from the member constituting the anode fixing body.

21 Claims, 16 Drawing Sheets

(52) U.S. Cl.
CPC ..... *H01J 35/26* (2013.01); *H01J 2235/1208* (2013.01); *H01J 2235/1295* (2013.01)

(58) Field of Classification Search
CPC ..... H01J 2235/083; H01J 2235/086; H01J 2235/10; H01J 2235/1006; H01J 2235/1013; H01J 2235/1046; H01J 2235/106; H01J 35/103–105; H01J 35/26
See application file for complete search history.

(56) References Cited

U.S. PATENT DOCUMENTS

| | | | | |
|---|---|---|---|---|
| 4,914,684 | A * | 4/1990 | Upadhya | F16C 25/08 378/125 |
| 4,969,172 | A | 11/1990 | Fengler et al. | |
| 6,449,339 | B2 * | 9/2002 | Yasutake | H01J 35/101 378/132 |
| 6,477,236 | B1 * | 11/2002 | Anno | H01J 35/105 378/127 |
| 6,707,882 | B2 * | 3/2004 | Bittner | H01J 35/101 378/130 |
| 7,127,035 | B2 * | 10/2006 | Anno | F16C 17/026 378/133 |

FOREIGN PATENT DOCUMENTS

| | | | |
|---|---|---|---|
| JP | 57-69153 | U | 4/1982 |
| JP | 1-163948 | | 6/1989 |
| JP | 5-174749 | | 7/1993 |
| JP | 7-245073 | | 9/1995 |
| JP | 11-176364 | A | 7/1999 |
| JP | 2003-68239 | A | 3/2003 |
| JP | 2004-63171 | | 2/2004 |
| JP | 2014-154497 | A | 8/2014 |

OTHER PUBLICATIONS

Written Opinion dated Apr. 19, 2016 in PCT/JP2016/052019 filed Jan. 25, 2016.
Combined Chinese Office Action and Search Report dated Jun. 22, 2018 in Patent Application No. 201680007290.X, 11 pages (with English language translation).
Office Action dated Jul. 17, 2018 in Korean Patent Application No. 10-2017-7021318 (with English translation). 8 pages.

* cited by examiner

ROTATING ANODE X-RAY TUBE

CROSS-REFERENCE TO RELATED APPLICATIONS

This application is a Continuation application of PCT Application No. PCT/JP2016/052019, filed Jan. 25, 2016 and based upon and claiming the benefit of priority from Japanese Patent Applications No. 2015-012991, filed Jan. 27, 2015; and No. 2015-253985, filed Dec. 25, 2015, the entire contents of all of which are incorporated herein by reference.

FIELD

Embodiments described herein relate generally to a rotating anode X-ray tube in which ball bearings are used in an anode rotating mechanism.

BACKGROUND

In general, in a rotating anode X-ray tube, an eccentrically arranged cathode and an anode target having a nearly umbrella shape are arranged in opposition to each other in a vacuum envelope in which a vacuum-tight atmosphere is held. The anode target is supported on a rotating mechanism, and is made rotatable. Outside the vacuum envelope, a stator is arranged to correspond to the rotating mechanism, and drives the rotating mechanism.

In a conventional rotating anode X-ray tube, the anode fixing body is formed of a material (containing a ferroalloy) having poor thermal conductivity, and hence there is a possibility of the temperature of the ball bearings, particularly, the temperature of the ball bearing closer to the anode target being raised high.

In the conventional rotating anode X-ray tube, the anode fixing body is normally formed of Fe, a ferroalloy or the like which is a magnetic substance material. The anode fixing body formed of a magnetic substance is opposed to a magnetic core of the stator coil with a rotor (rotating cylinder) held between them, thereby constituting a magnetic circuit. By virtue of the existence of the magnetic circuit, the density of the magnetic flux passing through the rotating cylinder is enhanced, and it is possible to rotate the rotating cylinder with a high degree of efficiency. Further, the rotating anode X-ray tube is normally provided with a high-radiation film configured to diffuse heat by radiation on the outer circumferential surface of the rotating cylinder.

DETAILED DESCRIPTION

According to one embodiment, a rotating shaft coaxially fixed to the inside of the rotating cylinder; an anode fixing body arranged between the rotating cylinder and the rotating shaft, extending in the axial direction, and constituted of one of a magnetic substance member formed of a magnetic substance and a heat-transfer enhancing member heat conductivity of which is higher than surrounding members; ball bearings provided between the anode fixing body and the rotating shaft; and an inner member arranged between the anode fixing body and the rotating shaft, connected to the anode fixing body by means of a connecting member, and constituted of one of the magnetic substance member and the heat-transfer enhancing member, one being different from the member constituting the anode fixing body.

Hereinafter, X-ray tubes according to the embodiments will be described in detail with reference to the accompanying drawings.

First Embodiment

Figure 1:
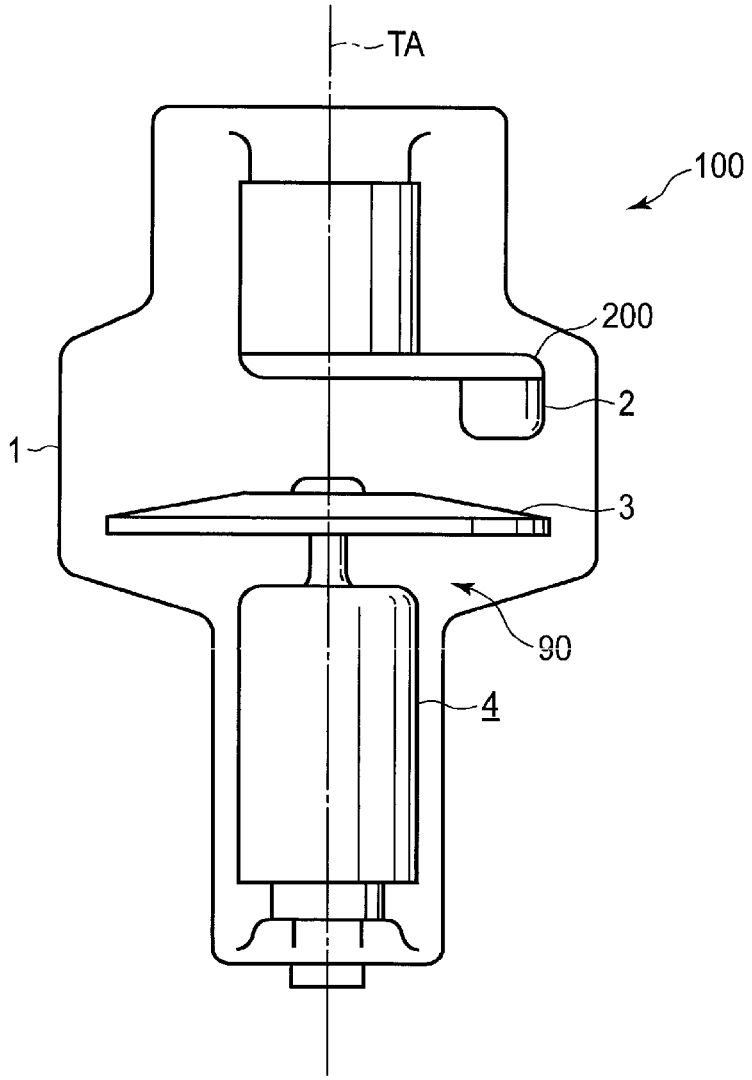
FIG. 1 is a schematic view showing an example of an X-ray tube of a first embodiment.

FIG. 1 is a schematic view showing an example of an X-ray tube 100 of a first embodiment.

The X-ray tube 100 is provided with a vacuum envelope 1, cathode 2, anode target 3, rotating mechanism 4, and cathode support 200. The X-ray tube 100 is a rotating anode X-ray tube. In the X-ray tube 100, the cathode 2 and the anode target (target disk) 3 having a nearly umbrella shape are arranged in opposition to each other in the vacuum envelope 1.

The vacuum envelope 1 is evacuated to a high vacuum. The vacuum envelope 1 contains the cathode 2 and an anode structural body 90 in the inside evacuated to a high vacuum. Further, the vacuum envelope 1 is constituted of, for example, a glass bulb made of glass. Inside the vacuum envelope 1, the cathode 2 and the anode target 3 are arranged in opposition to each other. The cathode 2 is retained by the cathode support 200 arranged in opposition to the anode target 3, and is arranged to be deviated from the tube axis TA (eccentrically). The cathode 2 emits electrons (electron beam) created by a high voltage toward the anode target 3.

The anode target 3 is formed into an umbrella-like and substantially disk-like shape. The anode target 3 is supported on a rotating mechanism 4, and is rotatably provided. The anode target 3 rotates according to the rotation of the rotating mechanism 4. The anode target 3 is formed of, for example, tungsten, and is constituted of a target layer configured to radiate X-rays, and a target substrate configured to support the target layer, and formed of, for example, molybdenum. The target layer is formed of, for example, tungsten. Further, the target substrate is formed of, for example, a molybdenum alloy (TZM). The surface of the anode target 3 formed into an umbrella-like shape is bombarded with an electron beam, whereby the anode target 3 radiates X-rays. While the X-ray tube assembly is driven, the anode target 3 is bombarded with an electron beam, and hence the temperature of the anode target 3 becomes high.

Hereinafter, the anode target 3 and the rotating mechanism 4 are collectively called an anode structural body 90. The anode structural body 90 includes a substantially umbrella-like anode target (target disk) 3 and a rotating mechanism 4.

Furthermore, on the outside of the vacuum envelope 1, a stator (stator coil) (not shown) is arranged to correspond to the rotating mechanism 4. This stator (not shown) is supplied with an electric current from a power source (not shown), whereby the stator generates a magnetic field and drives the rotating mechanism 4. The stator (not shown) constitutes a magnetic circuit together with a magnetic member formed of a magnetic substance with a rotating member (for example, a rotating cylinder 5 to be described later) interposed between them. In general, the magnetic circuit enhances the density of a magnetic flux passing through the rotating member, and makes it possible to efficiently rotate the rotating member.

It should be noted that a central axis of the X-ray tube 100 is referred to as a tube axis TA. Further, the part away from the tube axis TA in a direction perpendicular thereto is referred to the outside, and a direction to the tube axis TA is referred to as the inside. In the direction along the tube axis TA (hereinafter referred to as the axial direction), the part on the provision side of the cathode 2 is referred to as the front, and the part on the provision side of the anode structural body 90 is referred to as the rear. Further, the direction perpendicular to the axis TA is referred to as the radial direction.

Figure 2:
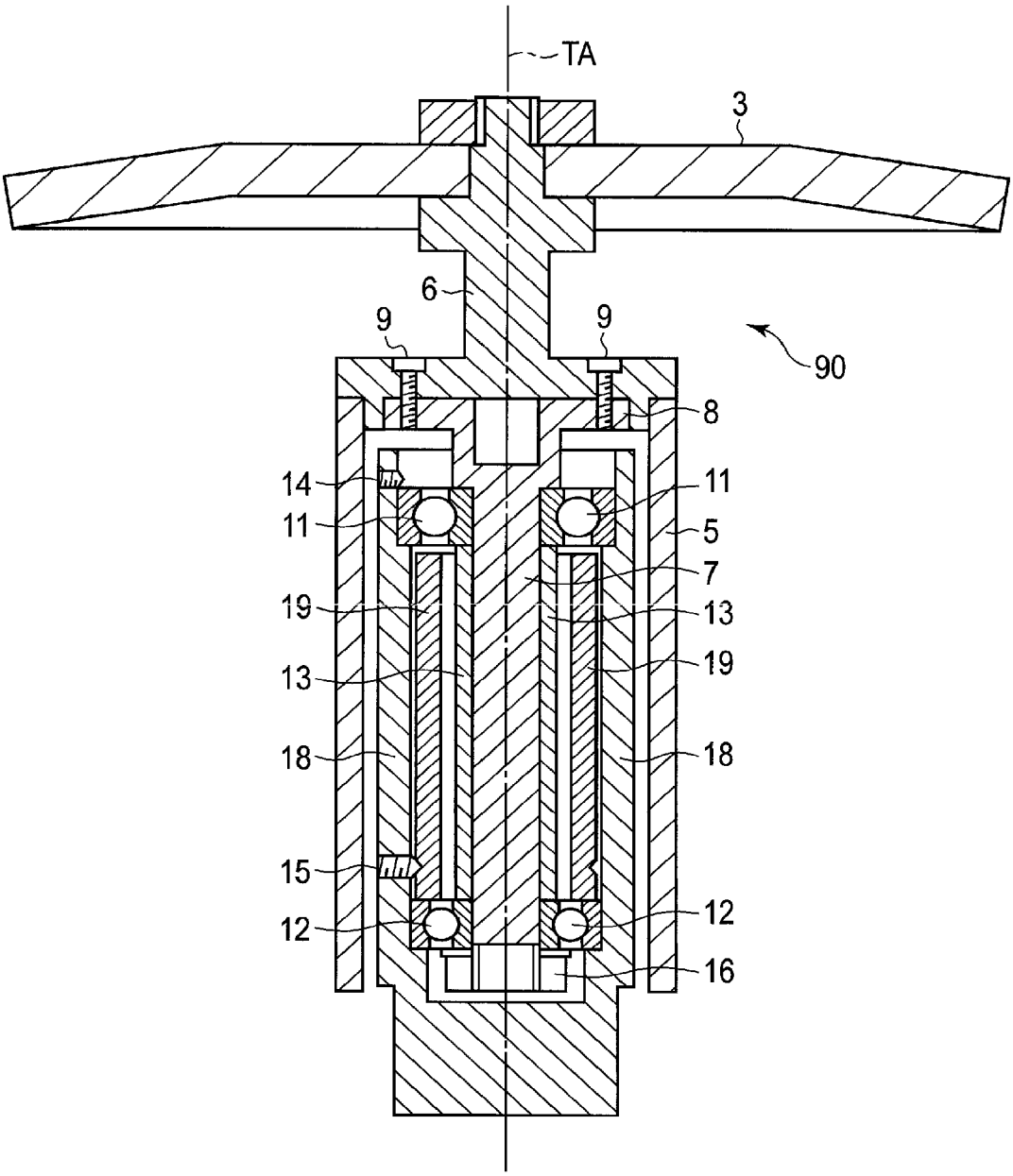
FIG. 2 is a vertical cross-sectional view showing an example of an anode structural body of the first embodiment.

FIG. 2 is a vertical cross-sectional view showing an example of the anode structural body 90 of this embodiment.

The rotating mechanism 4 of this embodiment is provided with a rotating cylinder (rotor) 5, supporting pillar 6 coaxially attached to the rotating cylinder 5, rotating shaft 7, circular disk 8, attaching screws 9, ball bearings 11 and 12, cylindrical spacer 13, fixing screws 14 and 15, fixing nut 16, anode fixing body 18, and inner member 19.

The rotating cylinder 5 is formed into a cylindrical shape having the tube axis TA as a central axis thereof. The rotating cylinder 5 is supported on the two ball bearings 11 and 12 provided in close contact with both end parts of the cylindrical spacer 13 arranged inside the anode fixing body 18 and on the outer circumferential part of the rotating shaft 7. Accordingly, the rotating cylinder 5 rotates at a high rotational speed according to the rotation of the rotating shaft 7 on the outside of the anode fixing body 18. The rotating cylinder 5 is formed of, for example, copper.

On the supporting pillar 6, the anode target 3 is almost coaxially fixed to the front thereof by means of a nut or the like. Further, on the supporting pillar 6, the rotating cylinder 5 is attached to the supporting pillar 6 almost coaxially along the outer circumference of the rear bottom part thereof.

The supporting pillar 6 and the circular disk 8 are fixed to each other by means of the attaching screws 9. The rotating shaft 7 is provided with the circular disk 8 formed integral with the shaft 7 at one end part thereof on the anode side. The rotating shaft 7 is fixed to the bottom end face of the supporting pillar 6 inside the rotating cylinder 5 coaxially with the tube axis TA through the circular disk 8.

In this embodiment, each of the ball bearings 11 and 12 is fixed between the rotating shaft 7 and the inner circumferential surface of the anode fixing body 18. In each of the ball bearings 11 and 12, rolling elements (balls) are provided between the ring-like inner race on the inner side and the ring-like outer race on the outer side. A retainer may be attached to the rolling elements so that the rolling elements can correctly roll. Here, the rolling elements are coated with a solid lubricant. Here, the solid lubricant is, for example, a soft metal-based lubricant constituted of lead, silver or the like. In the ball bearing 11, the outer race is fitted into a step part formed at the fixing screw 14 and on the inner circumferential part of the anode fixing body 18, and the inner race is brought into contact with the outer circumferential part of the rotating shaft 7 and is brought into contact with the cylindrical spacer 13 at the side part thereof, whereby the ball bearing 11 is fixed. Further, in the ball bearing 12, the outer race is fitted into a step part formed at the fixing screw 15, inner member 19, and on the inner circumferential part of the anode fixing body 18, and the inner race is brought into contact with the fixing nut 16, outer circumferential part of the rotating shaft 7, and is further brought into contact with the cylindrical spacer 13 at the side part thereof, whereby the ball bearing 12 is fixed. Here, at the outer circumferential part of the rotating shaft 7, the cylindrical spacer 13 is provided between the ball bearing 11 and the ball bearing 12 along the side part of the rotating shaft 7.

The anode fixing body 18 is formed into a closed-end (bottomed) cylindrical shape. The anode fixing body 18 is provided at a position opposed to the inner circumferential surface of the rotating cylinder 5. Further, in the direction parallel to the tube axis TA, the anode fixing body 18 is provided in such a manner that the anode fixing body 18 is inserted into the opening part from the side opposite to the side on which the rotating shaft 7 is fixed to the supporting pillar 6. In the anode fixing body 18, threaded hole parts into which the fixing screws (connecting members) 14 and 15 are to be screwed are formed at predetermined positions. The anode fixing body 18 contains therein the ball bearings 11 and 12, cylindrical spacer 13, and the like. In this embodiment, the anode fixing body 18 is constituted of a heat-transfer enhancing member which is a metallic member having thermal conductivity higher than the surrounding members. In this embodiment, the heat-transfer enhancing member of the anode fixing body 18 is formed of, for example, pure copper, a copper alloy, oxide-dispersion-strengthened copper or a copper-tungsten alloy.

The inner member 19 is provided in the space surrounded by the ball bearings 11 and 12, cylindrical spacer 13, and anode fixing body 18. That is, the inner member 19 is provided outside the cylindrical spacer 13, and inside the anode fixing body 18. The inner member 19 is fixed to the anode fixing body 18 with the fixing screw 15. In this embodiment, the inner member 19 is a magnetic substance member. The magnetic substance member is a metallic member formed of a magnetic substance. The magnetic substance member is formed of, for example, Fe or ferroalloy. Here, the inner member 19 is provided at a position opposed to the stator coil (not shown). Further, the inner member 19 is provided in such a manner that one end thereof fixes the ball bearing 12.

In the case where the anode fixing body 18 and the inner member 19 are joined to each other, there is a possibility of the thermal expansion causing spalling at the joint part or departure in dimension. However, in this embodiment, each of the anode fixing body 18 and the inner member 19 is arranged in such a manner that the thermal stress incidental to the thermal expansion is relieved. That is, as described previously, the anode fixing body 18 and the inner member 19 are fixed to each other with only the fixing screw 15, and hence a play part (redundant part) at which thermal deformation is allowed can be created.

In this embodiment, in the case where a high voltage is applied to the X-ray tube 100, the heat generated when X-rays are produced by bombarding the anode target 3 with electrons emitted from the cathode 2 is conducted to the ball bearing 11 and/or the ball bearing 12 through the supporting pillar 6. The ball bearings 11 and 12 are in contact with the anode fixing body 18 serving as the heat-transfer enhancing member, and hence the heat is conducted to the anode fixing body 18 and is radiated from the anode fixing body 18.

Figure 7:
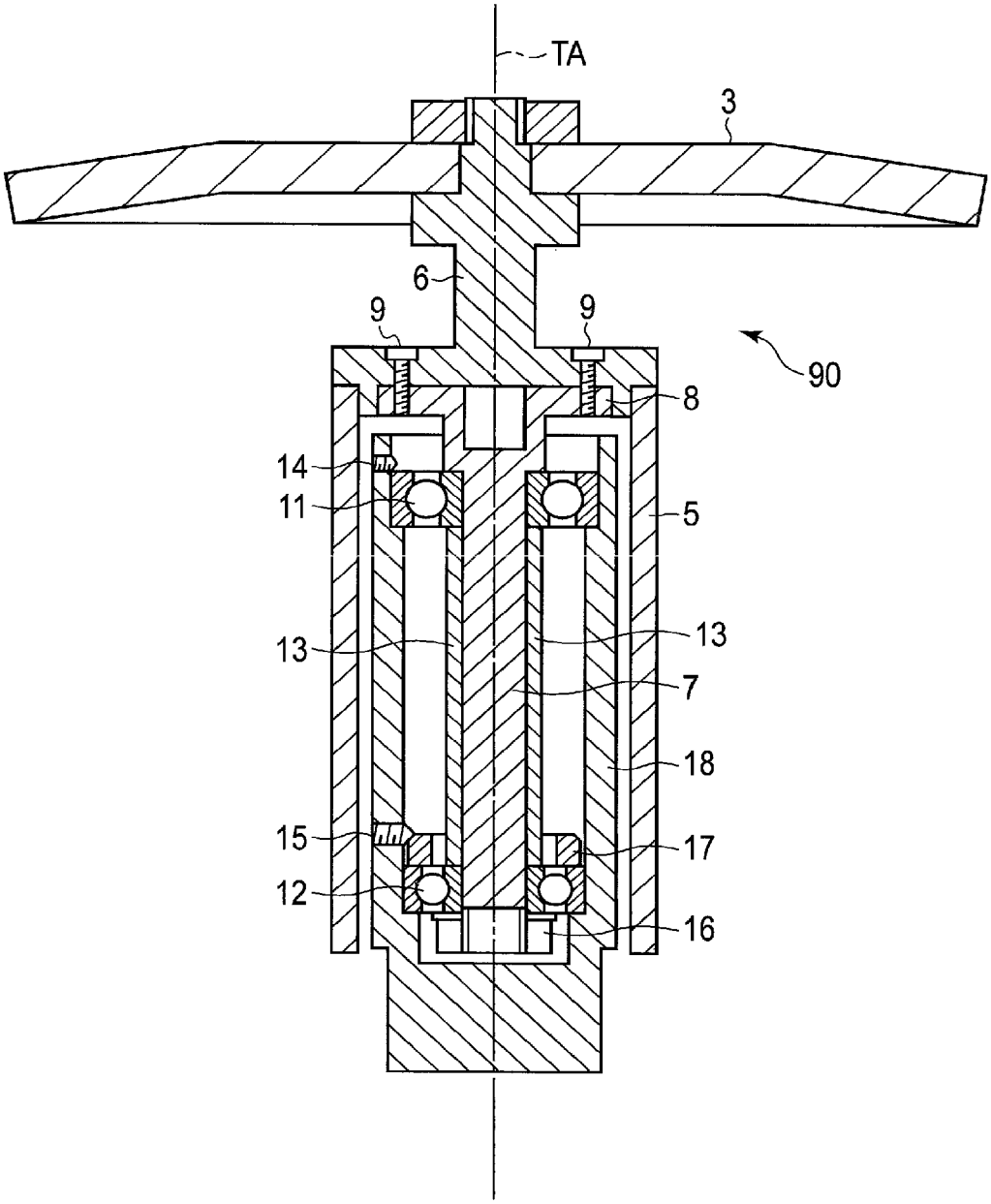
FIG. 7 is a view showing a conventional anode structural body which is a comparative example.

FIG. 7 is a view showing a conventional anode structural body 90 which is a comparative example, and the anode structural body 90 shown in FIG. 7 is a general anode structural body. In the anode structural body 90 of the comparative example, the anode fixing body 18 is constituted of a magnetic substance member, and a gap is formed between the anode fixing body 18 and the cylindrical spacer 13. In the comparative example, the anode fixing body 18 constitutes a magnetic circuit together with the stator coil (not shown) with the rotating cylinder 5 interposed between the anode fixing body 18 and the stator coil.

In this embodiment, the anode fixing body 18 of the conventional anode structural body 90 shown in the comparative example is a heat-transfer enhancing member, and hence in order to constitute a magnetic circuit together with the stator coil (not shown), the inner member 19 which is a magnetic substance member is provided between the cylindrical spacer 13 and the anode fixing body 18. Accordingly, in the anode structural body of this embodiment, a magnetic circuit is formed between the stator coil (not shown) and the anode fixing body 18.

According to this embodiment, the X-ray tube 100 is provided with the inner member 19 constituted of a magnetic substance member. Further, the anode fixing body 18 and the inner member 19 are fixed to each other with the fixing screw 15, and hence a play part at which each of the anode fixing body 18 and the inner member 19 is thermally deformed is created. In comparison with the case where the anode fixing body 18 and the inner member 19 are joined to each other, the anode fixing body 18 and the inner member 19 are connected to each other with the fixing screw 15 as separate bodies, whereby the thermal deformation is prevented from causing spalling at the joint part between the different types of members or deterioration in dimensional accuracy. In other words, deformation regions of the anode fixing body 18 and the inner member 19 are separated from each other for each of the different types of members, whereby spalling at the joint part between the different types of members or deterioration in dimensional accuracy caused by thermal deformation is resolved.

Further, although in the conventional X-ray tube 100 shown in FIG. 7, the anode fixing body 18 formed of a magnetic substance is constituted of a heat-transfer enhancing member, whereby heat radiation is promoted, the X-ray tube 100 of this embodiment includes the inner member 19 formed of a magnetic substance in order to secure the enhanced density of the magnetic flux formed by cooperation between the inner member 19 and the stator coil (not shown). Accordingly, the X-ray tube 100 of this embodiment can form a magnetic field having flux density equivalent to the conventional X-ray tube between the stator coil (not shown) and the inner member 19.

As a result, the X-ray tube 100 of this embodiment can prevent the temperature rise of the ball bearings 11 and 12, and can efficiently rotate the rotating cylinder 5.

Next, X-ray tubes according to other embodiments will be described below. In other embodiments, parts identical to the first embodiment described previously are denoted by reference symbols identical to the first embodiment, and detailed descriptions of them are omitted.

Second Embodiment

Although an X-ray tube 100 of a second embodiment is substantially equivalent to the X-ray tube 100 of the first embodiment, the X-ray tube 100 of this embodiment has a configuration in which members constituting the anode fixing body 18 and the inner member 19 are different from the X-ray tube 100 of the first embodiment.

Figure 3:
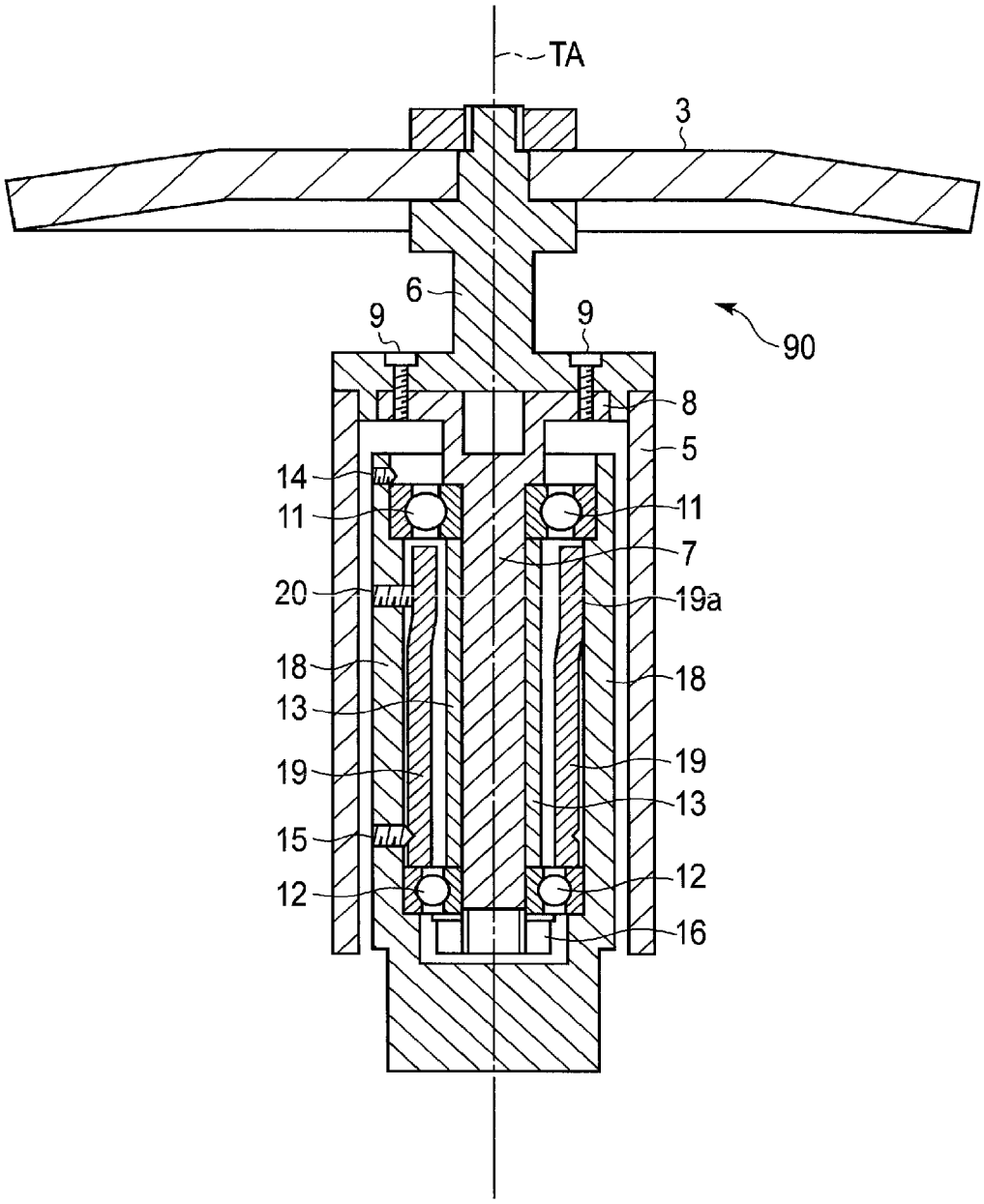
FIG. 3 is a vertical cross-sectional view showing an anode structural body of an X-ray tube of a second embodiment.

FIG. 3 is a vertical cross-sectional view showing an anode structural body 90 of the X-ray tube 100 of the second embodiment.

In the x-ray tube 100 of the second embodiment, the anode fixing body 18 is constituted of a magnetic substance member, and the inner member 19 is constituted of a heat-transfer enhancing member. That is, the X-ray tube 100 of the second embodiment has a configuration in which the members constituting the anode fixing body 18 and the inner member 19 are mutually replaced with those of the X-ray tube 100 of the first embodiment.

The anode fixing body 18 of this embodiment is constituted of a magnetic substance member. In the anode fixing body 18 of this embodiment, at least one threaded hole part into which a set-screw 20 configured to deform the inner member by pressing is to be screwed is formed in a predetermined part of the side part thereof. The threaded hole parts are formed at equal intervals in the circumferential direction of the inner member 19. Suitably, each of the threaded hole parts is formed in the vicinity of each of the ball bearings 11 and 12. Regarding the threaded hole parts, for example, three threaded hole parts are provided in the vicinity of the ball bearing 11.

The inner member 19 of this embodiment is constituted of a heat-transfer enhancing member. The inner member 19 is pressed from the outside toward the inside by at least one set-screw 20 through the threaded hole part of the anode fixing body 18 to thereby be deformed in the space between the cylindrical spacer 13 and the anode fixing body 18. At this time, in the inner member 19, the deformation amount becomes larger according to the volume of the part pressed by the set-screw 20. Further, when the deformation amount reaches a predetermined amount, the inner member 19 is brought into contact with part of the inner circumferential part of the anode fixing body 18. Here, the contact part at which the anode fixing body 18 and the inner member 19 are in contact with each other is called a deformation contact part 19*a*. When the inner member 19 is deformed by pressing, the deformation contact part 19*a* is called a pressing deformation part 19*a* in some cases.

When a plurality of set-screws 20 are provided, the set-screws 20 are provided at equal intervals in the circumferential direction of the inner member 19. Suitably, each of the set-screws 20 is provided to press the part in the vicinity of each of the ball bearings 11 and 12. For example, three set-screws 20 are provided in the vicinity of the ball bearing 11.

In order to relieve thermal stress caused by heat, the inner member 19 of this embodiment is formed in such a manner that the length thereof is shorter than the length between the ball bearings 11 and 12 in the direction parallel to the tube axis TA and/or the thickness thereof is smaller than the length (gap) between the cylindrical spacer 13 and the anode fixing body 18 in the direction perpendicular to the tube axis TA. In this case, the inner member 19 of this embodiment can relieve the thermal stress caused when heat is conducted thereto by being deformed (expansion). The inner member 19 of this embodiment is constituted of a member thermal conductivity of which is higher than the surrounding members and which is easily deformable. It should be noted that in this embodiment, the material for the heat-transfer enhancing member of the inner member 19 is, for example, pure copper or a copper alloy.

Hereinafter, deformation of the inner member 19 of this embodiment will be described with reference to the accompanying drawing.

Figure 4:
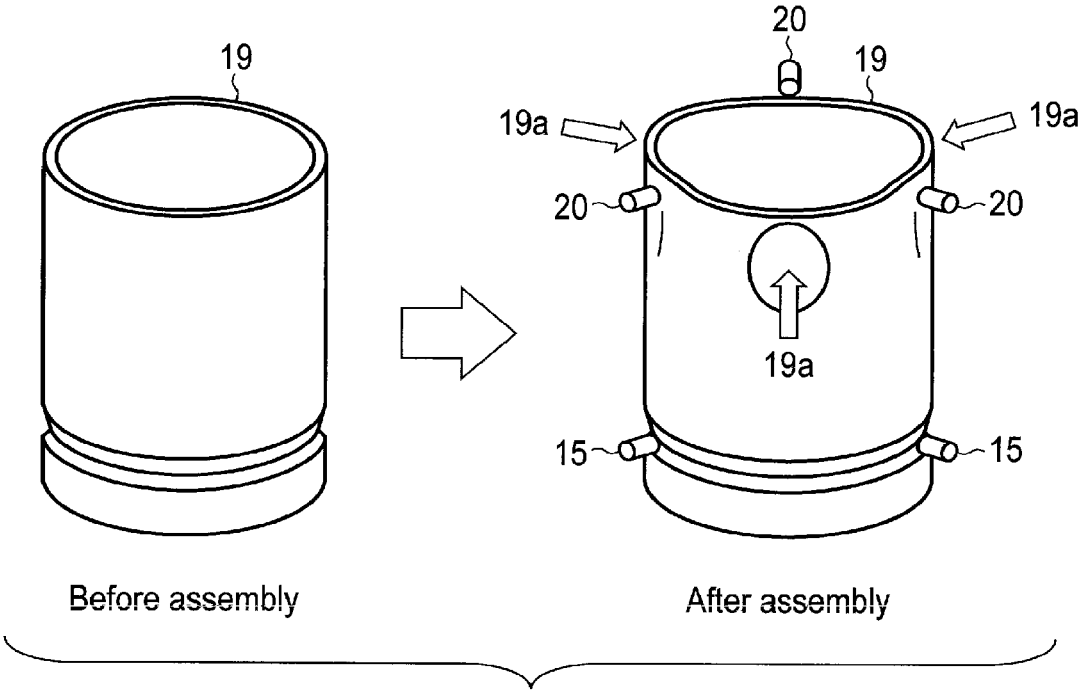
FIG. 4 is a schematic view of an inner member of the second embodiment.

FIG. 4 is a schematic view of the inner member 19 of this embodiment. Further, as shown in FIG. 4, a plurality of parts of the inner member 19 are pressed by the set-screws 20 screwed into the threaded hole parts provided in the anode fixing body 18, and the inner member 19 is partly deformed, whereby deformation contact parts 19*a* at which the anode fixing body 18 and the inner member 19 are in contact with each other are formed.

In this embodiment, in the case where a high voltage is applied to the X-ray tube 100, the heat generated when X-rays are produced by bombarding the anode target 3 with electrons emitted from the cathode 2 is conducted to the ball bearing 11 through the supporting pillar 6. The ball bearing 11 is in contact with the anode fixing body 18, and hence the heat is conducted to the anode fixing body 18, and then is conducted to the inner member 19 constituted of a heat-transfer member through the deformation contact parts 19*a*. The heat conducted to the inner member 19 is radiated from the rear end part of the anode fixing body 18. Further, the inner member 19 can relieve the thermal stress by carrying out thermal expansion deformation in the space between the outer side of the cylindrical spacer 13 and the inner side of the anode fixing body 18.

In this embodiment, the anode structural body 90 is provided with the inner member 19 inside the anode fixing body 18. The inner member 19 is deformed by being pressed at the outer circumferential surface thereof by means of at least one set-screw 20, and part of the inner member 19 is brought into contact with part of the inner circumferential part of the anode fixing body 18. At this time, the heat generated when X-rays are produced is conducted from the supporting pillar 6 to the inner member 19 through the ball bearing 11 and the anode fixing body 18. The inner member 19 can relieve the thermal stress caused by heat by being thermally deformed.

As a result, the X-ray tube 100 of this embodiment can prevent the temperature rise of the ball bearings 11 and 12, and can efficiently rotate the rotating cylinder 5.

Next, a modification example of the X-ray tube according to the second embodiment will be described below. In the modification example of the embodiment, parts identical to the aforementioned embodiment are denoted by reference symbols identical to the embodiment, and detailed descriptions of them are omitted.

Modification Example 1

Although an X-ray tube 100 of a modification example 1 of the second embodiment has a configuration almost equivalent to the aforementioned X-ray tube 100, the configuration of the anode structural body 90 is different from the aforementioned X-ray tube 100.

Figure 5:
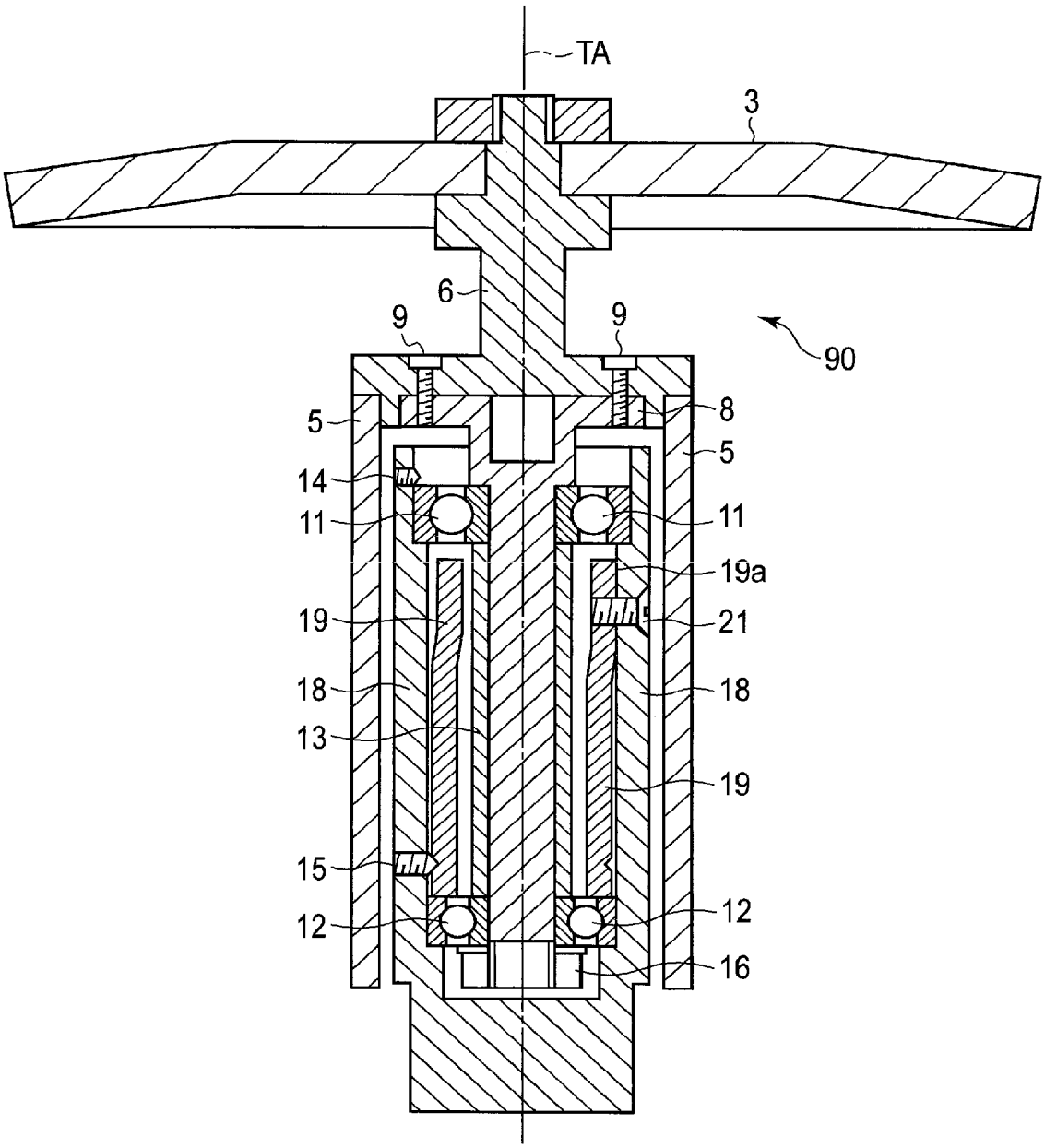
FIG. 5 is a vertical cross-sectional view showing an example of an anode structural body of a modification example 1 of the second embodiment.

FIG. 5 is a vertical cross-sectional view showing an example of an anode structural body 90 of the modification example 1 of the second embodiment.

In the anode structural body 90 of the modification example 1 of the second embodiment, part of the inner member 19 is deformed by being drawn by a drawing thread 21.

In the inner member 19 of the modification example 1, at least one threaded hole part into which the drawing thread 21 configured to carry out deformation by drawing is to be screwed is formed. Here, the threaded hole part is a threaded hole in which a thread groove is formed. The threaded hole parts are formed at equal intervals in the circumferential direction of the inner member 19. The threaded hole parts are suitably provided in the vicinity of each of the ball bearings 11 and 12. For example, three threaded hole parts are provided in the vicinity of the ball bearing 11. The inner member 19 is deformed in the space between the cylindrical spacer 13 and the anode fixing body 18 by being drawn from the outside by means of at least one drawing thread 21. At this time, in the inner member 19, the deformation amount becomes larger according to the volume of the part drawn by the drawing thread 21. Further, when the deformation amount reaches a predetermined amount, the inner member 19 is brought into contact with part of the inner circumferential part of the anode fixing body 18. That is, a deformation contact part 19*a* is formed. It should be noted that when the inner member 19 is drawn to be deformed, the deformation contact part 19*a* is called a drawing deformation part 19*a* in some cases.

The drawing threads 21 are provided at equal intervals in the circumferential direction of the inner member 19. Suitably, the plurality of drawing threads 21 are respectively provided in the vicinity of each of the ball bearings 11 and 12. For example, three drawing threads 21 are provided in the vicinity of the ball bearing 11.

Hereinafter, the deformation of the inner member 19 of the modification example 1 will be described with reference to the accompanying drawing.

Figure 6:
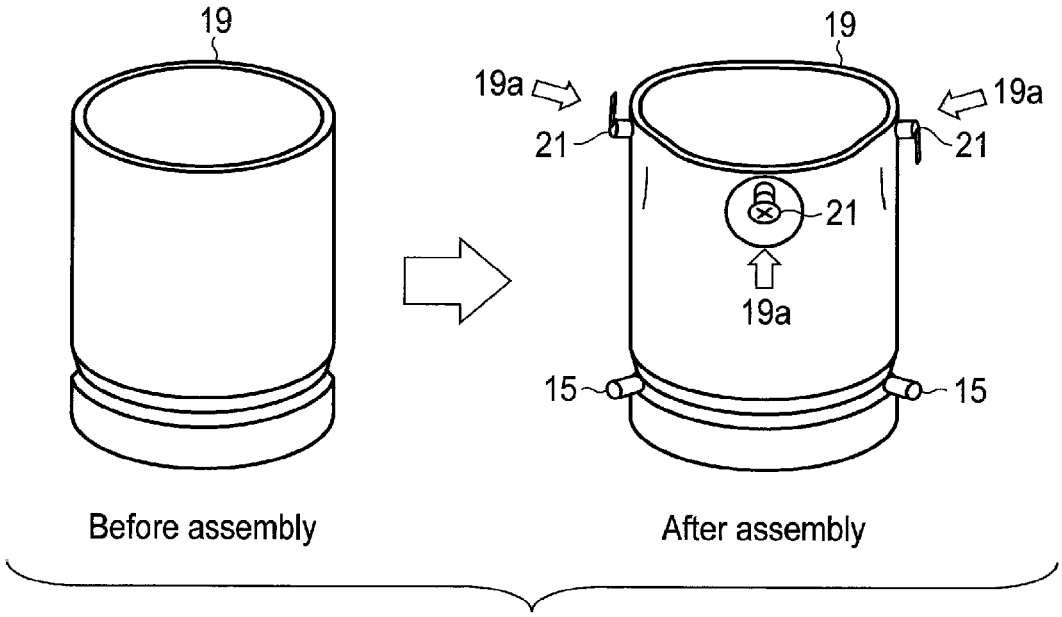
FIG. 6 is a schematic view of an inner member of the modification example 1 of the second embodiment.

FIG. 6 is a schematic view of an inner member 19 of the modification example 1 of this embodiment. Further, as shown in FIG. 6, a plurality of parts of the inner member 19 are drawn by drawing threads 21 screwed into the hole parts provided in the anode fixing body 18, and the inner member 19 is partly deformed, whereby deformation contact parts 19*a* at which the anode fixing body 18 and the inner member 19 are brought into contact with each other are formed.

According to this embodiment, regarding the anode fixing body 18 and the inner member 19, deformation contact parts 19*a* are formed by the drawing threads 21. In the X-ray tube 100 of this embodiment, the anode fixing body 18 and the inner member 19 are firmly fixed to each other by means of the drawing threads 21, and can be brought into contact with each other more securely than the second embodiment. Accordingly, deformation contact parts 19*a* are formed more securely than the X-ray tube 100 of the second embodiment.

According to this embodiment, the X-ray tube 100 is provided with the inner member 19 constituted of a heat-transfer enhancing member. The inner member 19 conducts heat to be conducted thereto through the supporting pillar 6. Further, the anode fixing body 18 and the inner member 19 are fixed to each other by only the fixing screw 15 and the deformation contact parts 19*a*, and hence a play part at which each of the anode fixing body 18 and the inner member 19 are thermally deformed is created. Deformation regions of the anode fixing body 18 and the inner member 19 are separated from each other for each of the different types of members, whereby spalling at the joint part between the different types of members or deterioration in dimensional accuracy caused by thermal deformation is resolved.

Further, although in the conventional X-ray tube 100 shown in FIG. 7, the anode fixing body 18 formed of a magnetic substance is constituted of a heat-transfer enhancing member, whereby heat radiation is promoted, the X-ray tube 100 of this embodiment includes the inner member 19 formed of a magnetic substance in order to secure the enhanced density of the magnetic flux formed by cooperation between the inner member 19 and the stator coil (not shown). Accordingly, the X-ray tube 100 of this embodiment can form a magnetic field having flux density equivalent to the conventional X-ray tube between the stator coil (not shown) and the inner member 19.

As a result, the X-ray tube 100 of this embodiment can prevent the temperature rise of the ball bearings 11 and 12, and can efficiently rotate the rotating cylinder 5.

Although in the aforementioned embodiment, the two ball bearings 11 and 12 include inner races, the inner races may be omitted, and bearing races may be provided on the rotating shaft 7. Further, although in the aforementioned embodiment, the two ball bearings 11 and 12 include outer races, the outer races may be omitted, and bearing races may be provided on the anode fixing body 18.

Next, an X-ray tube assembly according to another embodiment will be described below. In another embodiment, parts identical to the aforementioned embodiment are denoted by reference symbols identical to the aforementioned embodiment, and detailed descriptions of them are omitted.

Third Embodiment

Figure 8:
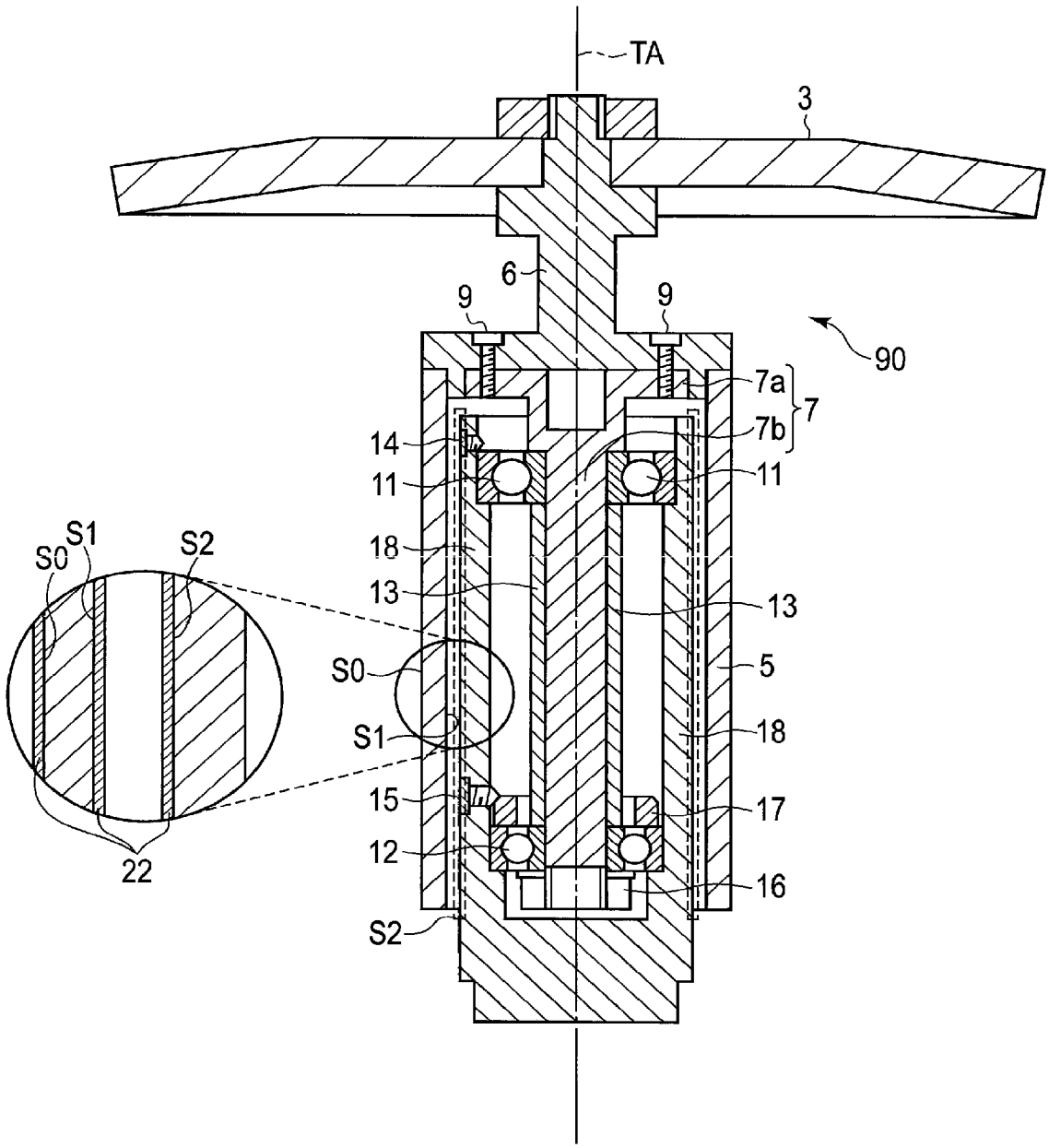
FIG. 8 is a vertical cross-sectional view showing an example of an anode structural body of a third embodiment.

FIG. 8 is a vertical cross-sectional view showing an example of an anode structural body 90 of a third embodiment.

The rotating mechanism 4 of this embodiment is provided with a rotating cylinder (rotor) 5, supporting pillar 6 substantially coaxially attached to the rotating cylinder 5, rotating shaft 7, attaching screws 9, ball bearings 11 and 12, cylindrical spacer 13, fixing screws 14 and 15, fixing nut 16, fixing ring 17, anode fixing body 18, and high-radiation films 22.

As shown in FIG. 8, in the rotating cylinder 5, the outer circumferential part is designated as the outer circumferential surface S0, and the inner circumferential part is designated as the inner circumferential surface S1.

On the supporting pillar 6, the anode target 3 is almost coaxially fixed to the front part thereof by means of a nut or the like. Further, on the supporting pillar 6, the rotating cylinder 5 is almost coaxially fixed to the rear bottom surface thereof along the outer circumference.

The rotating shaft 7 is provided with a circular disk 7*a* provided at the tip end part thereof, and a columnar part 7*b* extending vertically toward the rear from the center of the circular disk 7*a*. The circular disk 7*a* is fixed almost coaxially to the bottom surface of the supporting pillar 6 with the attaching screws 9. At this time, the circular disk 7*a* is fixed to the bottom surface of the supporting pillar 6 inside the rotating cylinder 5. On the columnar part 7*b*, a thread groove on which the fixing nut 16 is to be threadably mounted is formed on the outer circumferential part of the rear end part thereof. The rotating shaft 7 is rotated at a high rotational speed by a magnetic circuit constituted of a stator coil (not shown) and a magnetic substance member. At this time, the supporting pillar 6 fixed to the rotating shaft 7, and the rotating cylinder 5 fixed to the supporting pillar 6 are rotated at a high rotational speed according to the rotation of the rotating shaft 7.

The ball bearings 11 and 12 support the rotating cylinder 5 and the anode fixing body 18. Each of the ball bearings 11 and 12 is fixed between the columnar part 7*b* of the rotating shaft 7 and the inner circumferential surface of the anode fixing body 18. For example, the ball bearings 11 and 12 are respectively provided by being fitted on the front tip end part of the columnar part 7*b* and the rear tip end part of the columnar part 7*b*.

In the ball bearing 11, the outer race thereof is fixed by the step formed at the fixing screw 14 and on the inner circumferential part of the anode fixing body 18, and the inner race thereof is fixed by the step formed on the outer circumferential part of the columnar part 7*b* and the cylindrical spacer 13.

Further, in the ball bearing 12, the outer race thereof is fixed by the fixing ring 17 fixed by the fixing screw 15 and the step formed on the inner circumferential part of the anode fixing body 18, and the inner race thereof is fixed by the fixing nut 16 threadably mounted on the rear part of the columnar part 7*b* and the cylindrical spacer 13.

The cylindrical spacer 13 is provided on the outer circumferential part of the columnar part 7*b*, and between the ball bearing 11 and the ball bearing 12 along the outer circumferential part of the columnar part 7*b*. For example, the cylindrical spacer 13 is provided by being fitted on the columnar part 7*b*.

The anode fixing body 18 is formed into a closed-end (bottomed) cylindrical shape, and fixes the ball bearings 11 and 12. The anode fixing body 18 is provided inside the rotating cylinder 5 and in such a manner that the opening part thereof is arranged on the front side. A gap is provided between the outer circumferential surface of the anode fixing body 18 and the inner circumferential surface of the rotating cylinder 5. The anode fixing body 18 is provided with a thread groove into which the fixing screw (connecting member) 14 is to be screwed at a predetermined part. Likewise, the anode fixing body 18 is provided with a thread groove into which the fixing screw (connecting member) 15 is to be screwed at a predetermined part. As shown in FIG. 8, in the anode fixing body 18, the outer circumferential part is designated as the outer circumferential surface S2. For example, the outer circumferential surface S2 is a region opposed to the inner circumferential surface S1 of the rotating cylinder 5.

In this embodiment, the anode fixing body 18 is constituted of a magnetic substance member. For example, the magnetic substance member is formed of Fe or ferroalloy. At this time, the anode fixing body 18 constitutes a magnetic circuit together with the stator coil (not shown).

The high-radiation film 22 is constituted of a substance radiating heat. For example, the high-radiation film 22 is constituted of a material having at least one of triiron tetraoxide (chemical formula: $Fe_3O_4$), aluminum oxide, and titanium oxide as a principal ingredient. For example, the high-radiation film 22 is formed on the predetermined parts of the X-ray tube 100 by subjecting the parts to surface treatment to be carried out by vapor deposition such as thermal spraying, ion plating, and the like. In this embodiment, the high-radiation film 22 is formed on each of the outer circumferential surface S0, inner circumferential surface S1, and outer circumferential surface S2. It should be noted that it is sufficient if the high-radiation film 22 is formed on at least one of the inner circumferential surface S1 and the outer circumferential surface S2. Suitably, the high-radiation film 22 may not be formed on the part for which temperature rise should be prevented. For example, the high-radiation film 22 may not be formed on the parts opposed to the ball bearings 11 and 12.

In this embodiment, when a high voltage is applied to the X-ray tube, the heat generated by bombarding the anode target 3 with an electron beam emitted from the cathode 2 is conducted to the ball bearing 11 and/or the ball bearing 12 through the supporting pillar 6. The heat conducted to the ball bearing 11 and/or the ball bearing 12 is then conducted to the anode fixing body 18 and is radiated from the end part of the anode fixing body 18 on the side farther from the anode target 3 (rear end part of the anode fixing body 18) to the outside of the anode structural body 90.

Further, the heat generated at the anode target 3 is also conducted to the rotating cylinder 5 through the supporting pillar 6. Although the heat conducted to the rotating cylinder 5 is radiated to the outside of the anode structural body 90 by the high-radiation film 22 formed on the outer circumferential surface S0, part of the heat is absorbed by the high-radiation film 22 formed on the outer circumferential surface S2 of the anode fixing body 18, is then conducted through the anode fixing body 18, and is radiated from the end part of the anode fixing body 18 on the side farther from the anode target 3 (rear end part of the anode fixing body 18) to the outside of the anode structural body 90.

As described above, the diffusibility of the heat conducted from the anode target 3 through the supporting pillar 6 is enhanced by the high-radiation film 22, and hence the heat conducted to the ball bearings 11 and 12 is reduced. As a result, the temperature rise of the ball bearings 11 and 12 is prevented.

According to this embodiment, in the X-ray tube 100, the high-radiation film 22 is formed on each of the outer circumferential surface S0 and the inner circumferential surface S1 of the rotating cylinder 5, and the outer circumferential surface S2 of the anode fixing body 18. Part of the heat conducted from the anode target 3 to the rotating cylinder 5 is radiated by the high-radiation films 22 to the outside of the anode structural body 90 through the rotating cylinder 5 and the anode fixing body 18. As a result, the heat conducted from the anode target 3 to the ball bearings 11 and 12 is reduced.

As described above, the X-ray tube 100 of this embodiment can promote radiation of heat by means of the high-radiation films 22. Accordingly, the X-ray tube 100 can prevent the temperature rise of the ball bearings 11 and 12, and efficiently rotate the rotating cylinder 5.

It should be noted that the rotating cylinder 5 may be a heat-transfer enhancing member formed of a metallic material having thermal conductivity higher than the surrounding members. For example, the heat-transfer enhancing member is a metallic member having thermal conductivity higher than the ball bearings 11 and 12. Further, the heat-transfer enhancing member is formed of, for example, pure copper, a copper alloy, oxide-dispersion-strengthened copper or a copper-tungsten alloy. Further, the anode fixing body 18 may be a heat-transfer enhancing member. In this case, it is possible to radiate the heat conducted to the ball bearings 11 and 12 to the outside more efficiently than the X-ray tube 100 of this embodiment.

Fourth Embodiment

Figure 9:
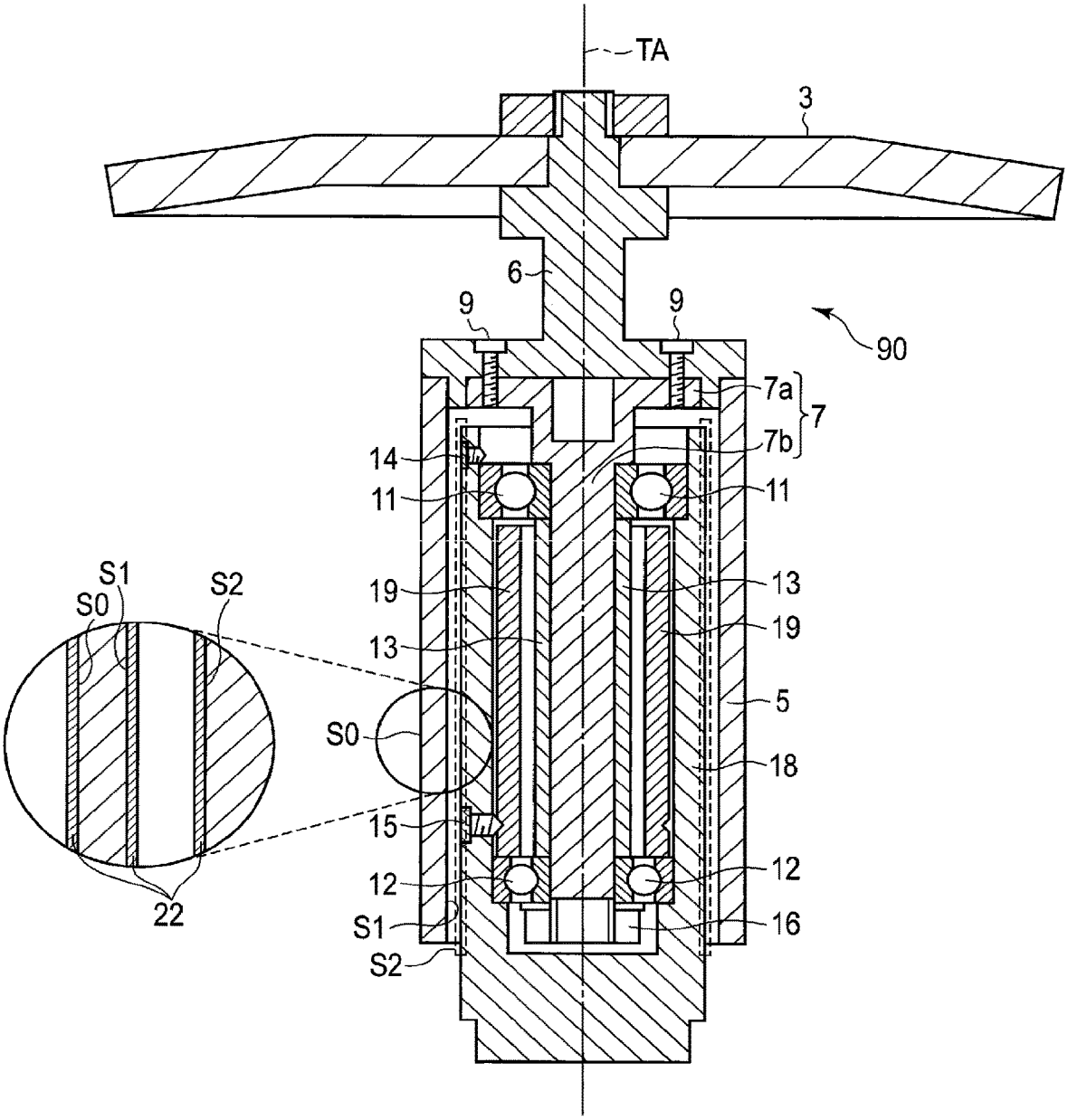
FIG. 9 is a vertical cross-sectional view showing an example of an anode structural body of an X-ray tube of a fourth embodiment.

FIG. 9 is a vertical cross-sectional view showing an example of an anode structural body 90 of an X-ray tube 100 of a fourth embodiment.

The anode structural body 90 according to the fourth embodiment is further provided with an inner member 19 in addition to the configuration of the third embodiment.

In this embodiment, the anode fixing body 18 is a heat-transfer enhancing member formed of a metallic material having thermal conductivity higher than the surrounding members. The heat-transfer enhancing member is, for example, a metallic member having thermal conductivity higher than the ball bearings 11 and 12. The heat-transfer enhancing member is formed of, for example, pure copper, a copper alloy, oxide-dispersion-strengthened copper or a copper-tungsten alloy.

The inner member (fixed cylinder) 19 is a metallic member having a substantially cylindrical shape. The inner member 19 is provided in the space surrounded by the ball bearings 11 and 12, cylindrical spacer 13, and anode fixing body 18. That is, the inner member 19 is provided outside the cylindrical spacer 13 and inside the anode fixing body 18.

In this embodiment, the inner member 19 is a magnetic substance member. Here, in order to form a magnetic circuit together with the stator coil (not shown), the inner member 19 is provided to correspond to the stator coil (not shown). The inner member 19 is connected to the anode fixing body 18 by means of a fixing screw 15. It should be noted that the inner member 19 may be in contact with, for example, the ball bearing 11 and/or the ball bearing 12 when certain space allowing thermal deformation resulting from thermal expansion is secured.

In the case where the inner member 19 is joined to the inner circumferential part of the anode fixing body 18 by brazing or the like, there is a possibility of the thermal expansion causing spalling at the joint part or departure in dimension. However, in this embodiment, as described previously, the inner member 19 is fixed to the anode fixing body 18 and the ball bearing 12 by means of the fixing screw 15, and hence a play part (redundant part) allowing thermal deformation can be created. Accordingly, each of the anode fixing body 18 and the inner member 19 is arranged in such a manner that thermal stress incidental to thermal expansion is relieved. In this case, the inner member 19 is, as compared with the case where the inner member 19 is joined to the anode fixing body 18 by brazing or the like, connected to the anode fixing body 18 and the ball bearing 12 by means of the fixing screw 15 as a separate body, whereby the thermal deformation is prevented from causing spalling at the joint part between the different types of members or deterioration in dimensional accuracy. In other words, deformation regions of the anode fixing body 18 and the inner member 19 are separated from each other for each of the different types of members, whereby spalling at the joint part between the different types of members or deterioration in dimensional accuracy caused by thermal deformation is resolved.

In this embodiment, the high-radiation film 22 is formed on each of the outer circumferential surface S0, inner circumferential surface S1, and outer circumferential surface S2. It should be noted that it is sufficient if the high-radiation film 22 is formed on at least one of the inner circumferential surface S1 and the outer circumferential surface S2.

In this embodiment, when a high voltage is applied to the X-ray tube 100, the heat generated by bombarding the anode target 3 with an electron beam emitted from the cathode 2 is conducted to the ball bearing 11 and/or the ball bearing 12 through the supporting pillar 6. The heat conducted to the ball bearing 11 and/or the ball bearing 12 is then conducted to the anode fixing body 18 serving as a heat-transfer enhancing member. The heat conducted to the anode fixing body 18 is further conducted through the anode fixing body 18 and is radiated from the rear end part thereof (end part on the side farther from the anode target 3) to the outside of the anode structural body 90.

The heat generated at the anode target 3 is also conducted to the rotating cylinder 5 through the supporting pillar 6. Although the heat conducted to the rotating cylinder 5 is radiated to the outside of the anode structural body 90 by the high-radiation film 22 formed on the outer circumferential surface S0, part of the heat is absorbed by the high-radiation film 22 formed on the outer circumferential surface S2 of the anode fixing body 18, then is conducted through the anode fixing body 18, and is radiated from the rear end part of the anode fixing body 18 to the outside of the anode structural body 90.

As described above, the diffusibility of the heat conducted from the anode target 3 through the supporting pillar 6 is enhanced by the high-radiation films 22 and the heat-transfer enhancing member, and hence the heat conducted to the ball bearings 11 and 12 is reduced. As a result, the temperature rise of the ball bearing 11 and the ball bearing 12 is prevented.

According to this embodiment, the X-ray tube 100 is provided with the anode fixing body 18 constituted of the heat-transfer enhancing member, and the inner member 19 formed of the magnetic substance. The anode fixing body 18 radiates the heat conducted thereto through the supporting pillar 6 from the rear end part thereof.

Furthermore, in the X-ray tube 100 of this embodiment, a high-radiation film 22 is provided on each of the outer circumferential surface S0 and the inner circumferential surface S1 of the rotating cylinder 5, and the outer circumferential surface S2 of the anode fixing body 18. The heat generated at the anode target 3 by being bombarded with electrons emitted from the cathode 2 is radiated to the outside of the anode structural body 90 by the high-radiation films 22.

As described above, the X-ray tube 100 of this embodiment can promote radiation of heat by means of the anode fixing body 18 constituted of the heat-transfer enhancing member and the high-radiation films 22, and can secure the enhanced density of the magnetic flux by means of the inner member 19 formed of a magnetic substance, the magnetic flux being generated by cooperation between the inner member 19 and the stator coil (not shown). Accordingly, the X-ray tube 100 can prevent the temperature rise of the ball bearings 11 and 12, and can efficiently rotate the rotating cylinder 5.

Fifth Embodiment

Figure 10:
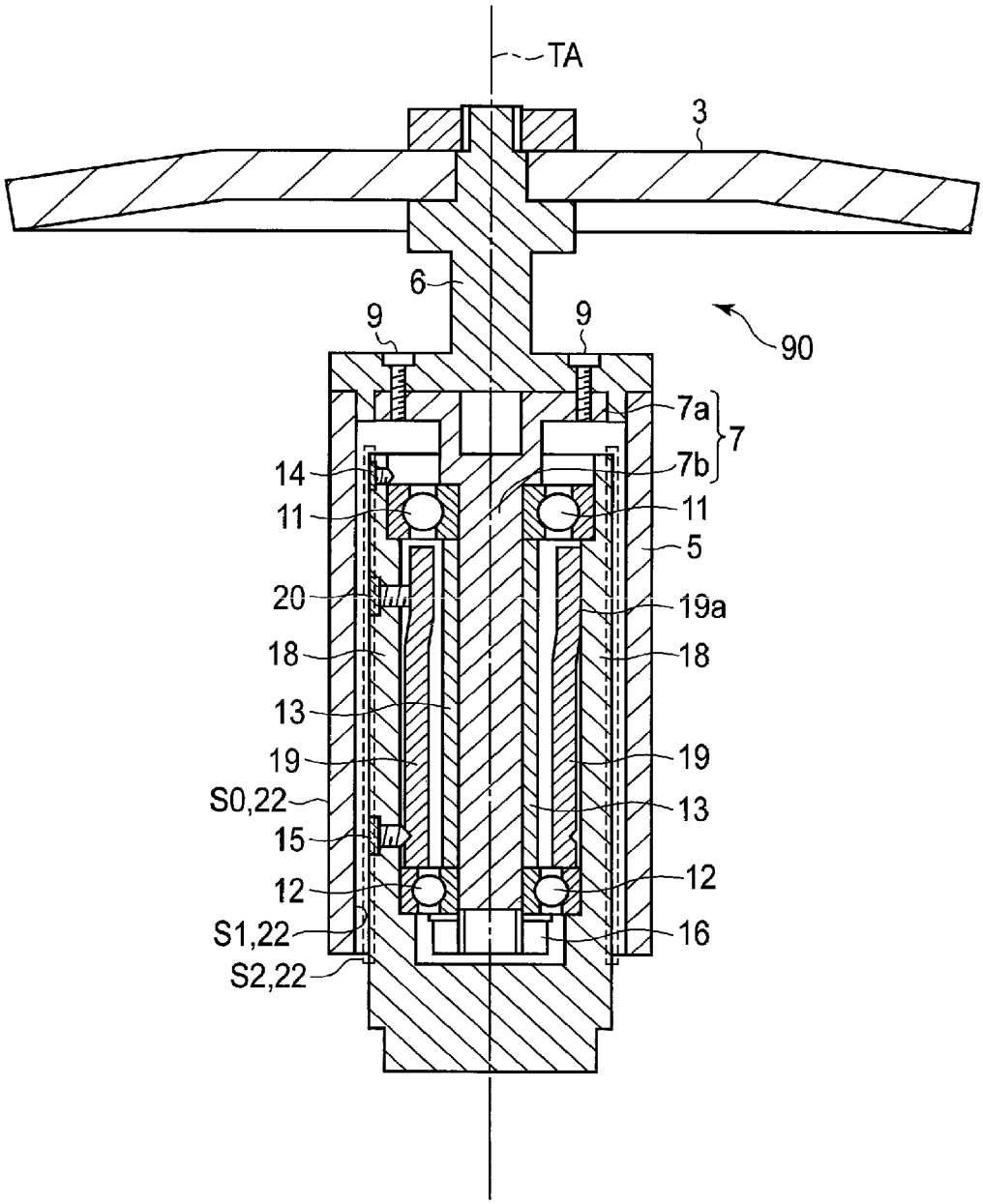
FIG. 10 is a vertical cross-sectional view showing an example of an anode structural body of an X-ray tube of a fifth embodiment.

FIG. 10 is a vertical cross-sectional view showing an example of an anode structural body 90 of an X-ray tube 100 of a fifth embodiment. In FIG. 10, although high-radiation films 22 are omitted, it is assumed that the high-radiation films 22 are formed on the surfaces for which the reference symbols of the high-radiation films are written together with those of the surfaces.

Although the anode structural body 90 according to the fifth embodiment has a configuration almost equivalent to the anode structural body 90 of the fourth embodiment, the anode structural body 90 of the fifth embodiment differs from that of the fourth embodiment in the members constituting the anode fixing body 18 and the inner member 19. That is, the anode structural body 90 according to the fifth embodiment has a configuration in which the members constituting the anode fixing body 18 and the inner member 19 are mutually replaced with those of the anode structural body 90 according to the fourth embodiment.

In this embodiment, the anode fixing body 18 is constituted of a magnetic substance member. The anode fixing body 18 is provided with at least one threaded hole part into which a set-screw 20 configured to deform the inner member 19 by pressing is to be screwed in a predetermined part thereof. Suitably, when a plurality of threaded hole parts are formed in the anode fixing body 18, the plurality of threaded hole parts are formed in the vicinity (or vicinities) of the ball bearing 11 and/or the ball bearing 12. More suitably, the plurality of threaded hole parts are formed at almost equal intervals in the circumferential direction of the anode fixing body 18. For example, the anode fixing body 18 is provided with three threaded hole parts in the vicinity of the ball bearing 11 at almost equal intervals in the circumferential direction. Further, the anode fixing body 18 may be provided with three threaded hole parts in the vicinity of the ball bearing 12 at almost equal intervals in the circumferential direction. Into the threaded hole parts in the vicinity of the ball bearing 12, set-screws 15 are screwed to thereby press the inner member 19 against the ball bearing 12.

Set-screws 20 are provided to be screwed into the threaded hole parts formed in the anode fixing body 18, and inwardly press the inner member 19.

In this embodiment, the inner member 19 is constituted of a heat-transfer enhancing member having thermal conductivity higher than the surrounding members and is easily deformable. The inner member 19 is formed of, for example, pure copper or a copper alloy. The inner member 19 is pressed from the outside toward the inside by means of at least one set-screw 20 through the threaded hole part of the anode fixing body 18 to thereby be deformed in the space between the cylindrical spacer 13 and the anode fixing body 18. At this time, in the inner member 19, the deformation amount becomes larger according to the volume of the part thereof pressed by the set-screw 20. When the deformation amount reaches a predetermined amount, the inner member 19 is brought into contact with part of the inner circumferential part of the anode fixing body 18. The part of the inner member 19 at which the inner member is brought into contact with the anode fixing body 18 is called a deformation contact part 19*a*. When the inner member 19 is deformed by pressing, the deformation contact part 19*a* is called a pressing deformation part 19*a* in some cases.

In order to relieve thermal stress caused by heat, the inner member 19 of this embodiment is formed in such a manner that the length thereof is shorter than the length between the ball bearings 11 and 12 in the axial direction, and the thickness thereof becomes smaller than the length (gap) between the cylindrical spacer 13 and the anode fixing body 18 in the radial direction. Accordingly, the inner member 19 can relieve thermal stress occurring when heat is conducted thereto by becoming deformed (expansion). It should be noted that the inner member 19 may be in contact with, for example, the ball bearing 11 and/or the ball bearing 12 when certain space allowing thermal deformation resulting from thermal expansion is secured.

Hereinafter, the deformation of the inner member 19 of the X-ray tube 100 of this embodiment will be described.

Figure 11:
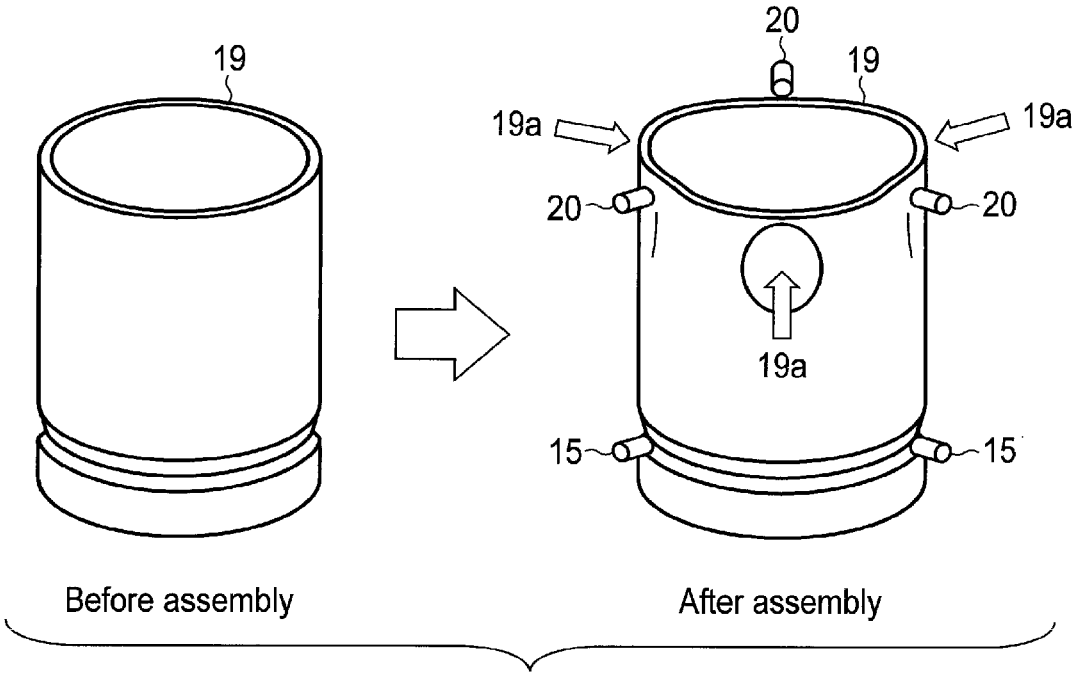
FIG. 11 is a schematic view of an inner member of the X-ray tube of the fifth embodiment.

FIG. 11 is a schematic view of the inner member 19 of the X-ray tube 100 of this embodiment.

Further, as shown in FIG. 11, the inner member 19 is inwardly pressed by the set-screws 20 screwed into the threaded holes formed in the anode fixing body 18, and part of the inner member 19 is deformed. Part (pressing deformation part 19*a*) of the inner member 19 is brought into contact with part of the inner circumferential part of the anode fixing body 18 according to the deformation of the inner member 19.

In this embodiment, the high-radiation film 22 is formed on each of the outer circumferential surface S0, inner circumferential surface S1, and outer circumferential surface S2. It should be noted that it is sufficient if the high-radiation film 22 is formed on at least one of the inner circumferential surface S1 and the outer circumferential surface S2.

In this embodiment, when a high voltage is applied to the X-ray tube 100, heat generated by bombarding the anode target 3 with an electron beam emitted from the cathode 2 is conducted to the ball bearing 11 and/or the ball bearing 12 through the supporting pillar 6. The heat conducted to the ball bearing 11 and/or the ball bearing 12 is then conducted to the anode fixing body 18. The heat conducted to the anode fixing body 18 is conducted to the inner member 19 constituted of the heat-transfer enhancing member through the deformation contact parts 19*a*. The inner member 19 can relieve thermal stress by carrying out thermal expansion deformation in the space between the outside of the cylindrical spacer 13 and the inside of the anode fixing body 18.

Furthermore, the heat generated at the anode target 3 is also conducted to the rotating cylinder 5 through the supporting pillar 6. Although the heat conducted to the rotating cylinder 5 is radiated to the outside of the anode structural body 90 by the high-radiation film 22 formed on the outer circumferential surface S0, part of the heat is absorbed by the high-radiation film 22 formed on the outer circumferential surface S2 of the anode fixing body 18, is then conducted through the inner member 19 constituted of a heat-transfer enhancing member via the anode fixing body 18 and the deformation contact parts 19*a*, and is radiated from the rear end part of the anode fixing body 18 to the outside of the anode structural body 90.

As described above, the diffusibility of the heat conducted from the anode target 3 through the supporting pillar 6 is enhanced by the high-radiation films 22 and the heat-transfer enhancing member, and hence the heat conducted to the ball bearings 11 and 12 is reduced. As a result, the temperature rise of the ball bearing 11 and the ball bearing 12 is prevented.

According to this embodiment, the X-ray tube 100 is provided with the anode fixing body 18 formed of a magnetic substance, and the inner member 19 constituted of a heat-transfer enhancing member. The inner member 19 is deformed by being pressed by at least one set-screw 20 at the outer circumferential surface thereof, and the deformation contact part 19*a* is brought into contact with the inner circumferential part of the anode fixing body 18. At this time, the heat generated at the anode target 3 is conducted from the supporting pillar 6 to the inner member 19 through the ball bearing 11 and the anode fixing body 18. The inner member 19 can relieve thermal stress caused by heat by being thermally deformed.

Further, the inner member 19 is fixed to the anode fixing body 18 by means of the fixing screw 15, and hence has a play part allowing thermal deformation between itself and the anode fixing body 18. The inner member 19 is, as compared with the case where the inner member 19 is joined to the anode fixing body 18 by brazing or the like, connected to the anode fixing body 18 by means of the fixing screw 15 as a separate body, whereby the thermal deformation is prevented from causing spalling at the joint part between the different types of members or deterioration in dimensional accuracy. In other words, deformation regions of the anode fixing body 18 and the inner member 19 are separated from each other for each of the different types of members, whereby spalling at the joint part between the different types of members or deterioration in dimensional accuracy caused by thermal deformation is resolved.

Furthermore, in the X-ray tube 100 of this embodiment, the high-radiation film 22 is formed on each of the outer circumferential surface S0 and the inner circumferential surface S1 of the rotating cylinder 5, and the outer circumferential surface S2 of the anode fixing body 18. The heat generated at the anode target 3 by being bombarded with electrons emitted from the cathode 2 is radiated to the outside of the anode structural body 90 by the high-radiation films 22.

As described above, the X-ray tube 100 of this embodiment can secure the enhanced density of the magnetic flux by means of the anode fixing body 18 formed of a magnetic substance, the magnetic flux being generated by cooperation between the anode fixing body 18 and the stator coil (not shown), and can relieve the thermal stress by means of the inner member 19 constituted of a heat-transfer enhancing member. Further, the X-ray tube 100 can promote radiation of heat by means of the high-radiation films 22. Accordingly, the X-ray tube 100 can prevent the temperature rise of the ball bearings 11 and 12, and can efficiently rotate the rotating cylinder 5.

Next, a modification example of the X-ray tube according to the fifth embodiment will be described below. In the modification example of the embodiment, parts identical to the aforementioned embodiment are denoted by reference symbols identical to the embodiment, and detailed descriptions of them are omitted.

Modification Example 2

Figure 12:
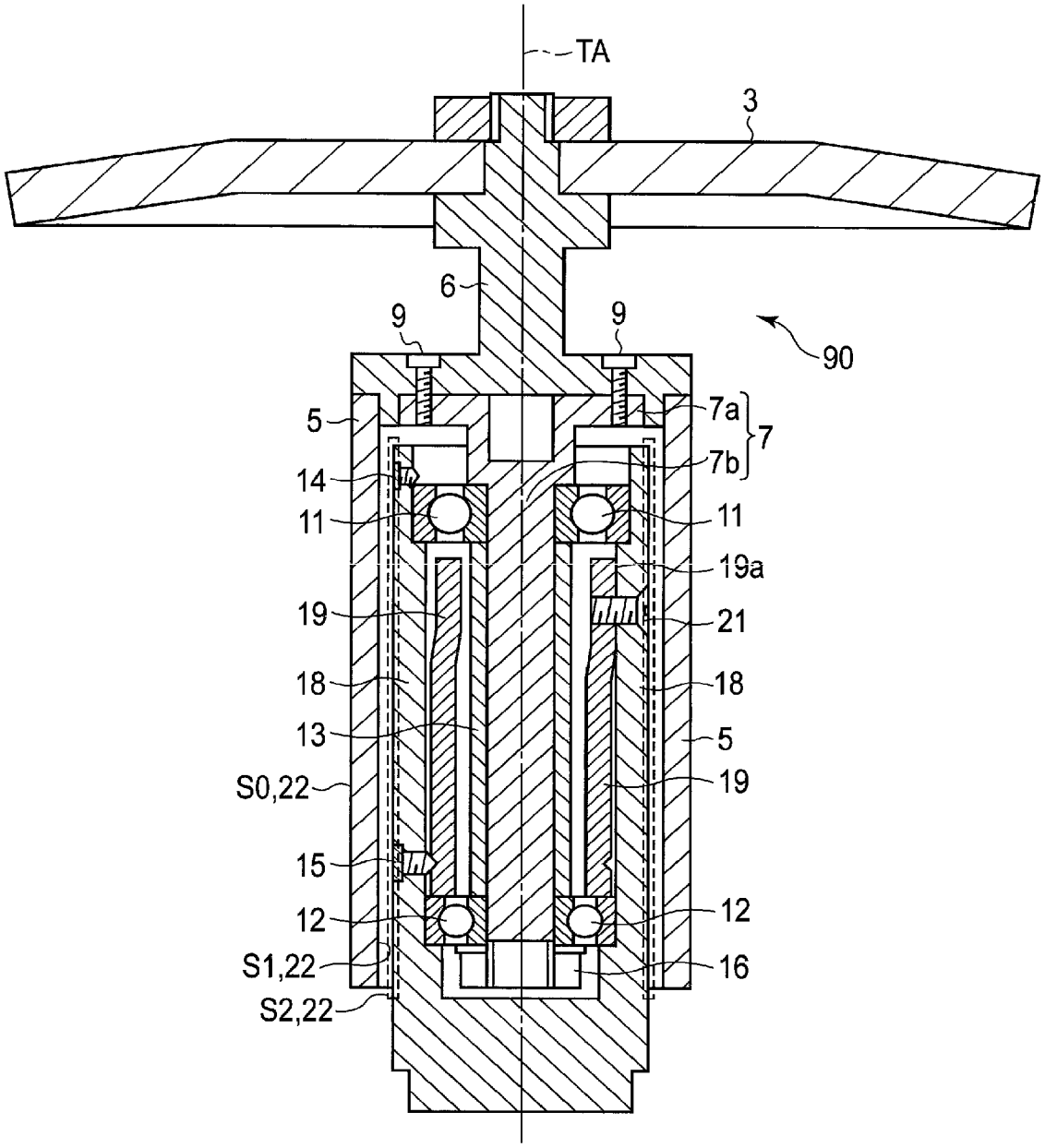
FIG. 12 is a vertical cross-sectional view showing an example of an anode structural body of a modification example 2 according to the X-ray tube of the fifth embodiment.

FIG. 12 is a vertical cross-sectional view showing an example of an anode structural body 90 of a modification example 2 according to the X-ray tube 100 of the fifth embodiment. In FIG. 12, although high-radiation films 22 are omitted, it is assumed that the high-radiation films 22 are formed on the surfaces for which the reference symbols of the high-radiation films are written together with those of the surfaces.

Although the anode structural body 90 of the modification example 2 of the fifth embodiment has a configuration almost equivalent to the anode structural body 90 of the fifth embodiment, part (deformation contact part 19*a*) of the inner member 19 is deformed by a drawing thread 21.

In the modification example 2, the anode fixing body 18 is provided with at least one hole part into which the drawing thread 21 configured to deform the inner member 19 by drawing (pulling nearer to itself) the inner member 19 is to be inserted at a predetermined part. Suitably, when a plurality of hole parts are formed in the anode fixing body 18, the plurality of hole parts are formed in the vicinity of the ball bearing 11. More suitably, the plurality of hole parts are formed at almost equal intervals in the circumferential direction of the anode fixing body 18. For example, the anode fixing body 18 is provided with three hole parts in the vicinity of the ball bearing 11 at almost equal intervals in the circumferential direction. Further, the anode fixing body 18 is provided with three threaded hole parts in the vicinity of the ball bearing 12 at almost equal intervals in the circumferential direction. Into the threaded holes, set-screws 15 are screwed, thereby pressing the inner member 19 against the ball bearing 12.

The drawing threads 21 are set in such a manner that the drawing threads 21 are inserted into the hole parts formed in the anode fixing body 18, are then screwed into threaded holes of the inner member 19 to be described later, and outwardly draw the inner member 19 with the anode fixing body 18 interposed between the drawing threads 21 and the inner member 19.

In the modification example 2, in the inner member 19, at least one threaded hole part into which the drawing thread 21 is to be screwed is formed. Each of these threaded hole parts is a female threads in which a thread groove is formed on the inner circumferential surface. Further, these thread hole parts are formed in predetermined parts of the inner member 19 corresponding to the hole parts of the anode fixing body 18. For example, the inner member 19 is provided with three threaded hole parts in the vicinity of the ball bearing 11 at almost equal intervals in the circumferential direction. Further, for example, the inner member 19 may be provided with three threaded hole parts in the vicinity of the ball bearing 12 at almost equal intervals in the circumferential direction.

The inner member 19 is outwardly drawn by at least one drawing thread 21 screwed into the threaded hole through the hole part of the anode fixing body 18, whereby the inner member 19 is deformed in the space between the cylindrical spacer 13 and the anode fixing body 18. At this time, in the inner member 19, the deformation amount becomes larger according to the volume of the part drawn by the drawing thread 21. Further, when the deformation amount reaches a predetermined amount, the inner member 19 is brought into contact with part of the inner circumferential part of the anode fixing body 18. That is, a deformation contact part 19*a* is brought into contact with the inner circumferential part of the anode fixing body 18. At this time, the inner member 19 is firmly fixed to the anode fixing body 18 by means of the drawing thread 21. It should be noted that when the inner member 19 is drawn to be deformed, this deformation contact part 19*a* is called a drawing deformation part 19*a* in some cases.

Hereinafter, the deformation of the inner member 19 of the modification example 2 will be described with reference to the drawing.

Figure 13:
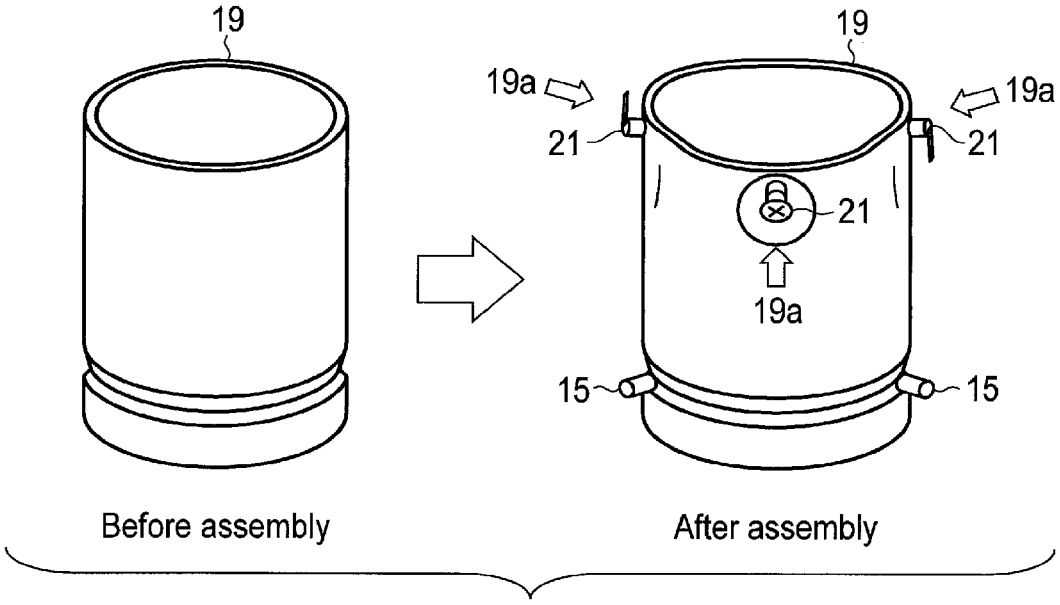
FIG. 13 is a schematic view of an inner member of the modification example 2 according to the X-ray tube of the fifth embodiment.

FIG. 13 is a schematic view of the inner member 19 of the modification example 2 according to the X-ray tube 100 of this embodiment.

Further, as shown in FIG. 13, the inner member 19 is outwardly drawn by the drawing threads 21 screwed into the threaded hole parts, and part of the inner member 19 is deformed. Part (drawing deformation parts 19*a*) of the inner member 19 is brought into contact with part of the inner circumferential part of the anode fixing body 18 according to the deformation of the inner member 19.

In the modification example 2, the high-radiation film 22 is formed on each of the outer circumferential surface S0, inner circumferential surface S1, and outer circumferential surface S2. It should be noted that it is sufficient if the high-radiation film 22 is formed on at least one of the inner circumferential surface S1 and the outer circumferential surface S2.

According to the modification example 2, the inner member 19 of the anode structural body 90 is deformed by being outwardly drawn by at least one drawing thread 21, and the drawing deformation part 19*a* is brought into contact with the inner circumferential part of the anode fixing body 18. At this time, the inner member 19 is firmly fixed to the anode fixing body 18 by means of the drawing thread 21. Accordingly, the drawing deformation part 19*a* of the inner member 19 is brought into contact with part of the inner circumferential part of the anode fixing body 18 more securely than the fourth embodiment. Accordingly, the heat generated at the anode target 3 is conducted from the supporting pillar 6 to the inner member 19 through the ball bearing 11 and the anode fixing body 18. The inner member 19 can relieve the thermal stress caused by heat by being thermally deformed.

Furthermore, the heat generated at the anode target 3 is also conducted to the rotating cylinder 5 through the supporting pillar 6. The heat conducted to the rotating cylinder 5 is radiated to the outside of the anode structural body 90 by the high-radiation film 22 formed on the outer circumferential surface S0. Further, part of the heat conducted to the rotating cylinder 5 is absorbed by the high-radiation film 22 formed on the outer circumferential surface S2 of the anode fixing body 18, is then conducted through the inner member 19 constituted of a heat-transfer enhancing member via the anode fixing body 18 and the deformation contact parts 19*a*, and is radiated from the rear end part of the anode fixing body 18 to the outside of the anode structural body 90.

As described above, the diffusibility of the heat conducted from the anode target 3 through the supporting pillar 6 is enhanced by the high-radiation film 22 and the heat-transfer enhancing member, and hence the heat conducted to the ball bearings 11 and 12 is reduced. As a result, the temperature rise of the ball bearing 11 and the ball bearing 12 is prevented.

The X-ray tube 100 of this embodiment can secure the enhanced density of the magnetic flux by means of the anode fixing body 18 formed of a magnetic substance, the magnetic flux being generated by cooperation between the anode fixing body 18 and the stator coil (not shown), and can relieve the thermal stress by means of the inner member 19 constituted of a heat-transfer enhancing member. Accordingly, the X-ray tube 100 can prevent the temperature rise of the ball bearings 11 and 12, and can efficiently rotate the rotating cylinder 5.

Sixth Embodiment

Figure 14:
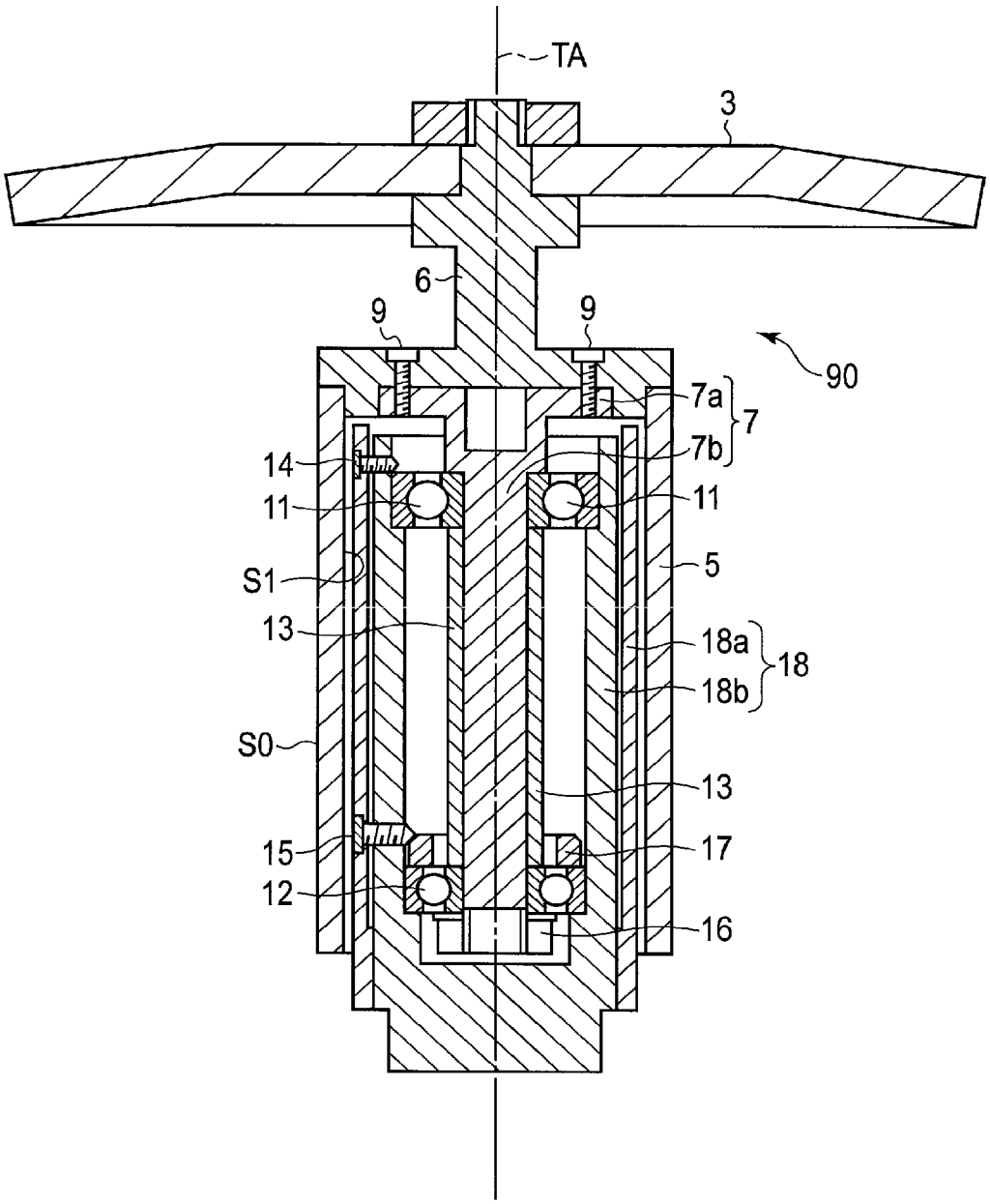
FIG. 14 is a vertical cross-sectional view showing an example of an anode structural body of an X-ray tube of a sixth embodiment.

FIG. 14 is a vertical cross-sectional view showing an example of an anode structural body 90 of an X-ray tube 100 of a sixth embodiment.

Although the anode structural body 90 according to the sixth embodiment has a configuration substantially equivalent to the anode structural body 90 of the aforementioned embodiment, the anode structural body 90 of this embodiment differs from the aforementioned embodiment in the configuration of the anode fixing body 18.

The anode fixing body 18 of this embodiment is provided with a heat-receiving cylinder (heat-transfer cylinder) 18*a* constituted of a heat-transfer enhancing member, and a main-body part 18*b* formed of a magnetic substance. The heat-receiving cylinder 18*a* has gaps between itself, the rotating cylinder 5, and the main-body part 18*b*, and part of the heat-receiving cylinder 18*a* is fixed to the main-body part 18*b* by brazing or the like. For example, the rear end portion of the heat-receiving cylinder 18*a* is fixed to the main-body part 18*b* by brazing or the like. Suitably, it is desirable that the heat-receiving cylinder 18*a* be fixed to the main-body part 18*b* at a part farther from the front than the ball bearing 12.

In this embodiment, when a high voltage is applied to the X-ray tube 100, part of the heat generated at the anode target 3 by being bombarded with an electron beam emitted from the cathode 2 is conducted to the rotating cylinder 5 through the supporting pillar 6. Although the heat conducted to the rotating cylinder 5 is radiated by the high-radiation film 22 formed on the outer circumferential surface S0 to the outside of the anode structural body 90, part of the heat is absorbed by the outer circumferential surface of the heat-receiving cylinder 18*a* constituted of the heat-transfer enhancing member. The heat absorbed by the heat-receiving cylinder 18*a* is conducted through the heat-receiving cylinder 18*a*, and is then conducted to the rear part of the main-body part 18*b* to which part of the heat-receiving cylinder 18*a* is fixed. The heat conducted to the rear part of the main-body part 18*b* is radiated to the outside of the anode structural body 90.

As described above, the diffusibility of the heat conducted from the anode target 3 through the supporting pillar 6 is enhanced by the heat-receiving cylinder 18*a*, and hence the heat conducted to the ball bearings 11 and 12 is reduced. As a result, the temperature rise of the ball bearings 11 and 12 is prevented.

According to this embodiment, the anode fixing body 18 is provided with the heat-receiving cylinder 18*a* constituted of the heat-transfer enhancing member, and the main-body part 18*b* formed of the magnetic substance. The heat conducted from the anode target 3 to the rotating cylinder 5 is radiated by, for example, the heat-receiving cylinder 18*a* to the outside of the anode structural body 90 through the main-body part 18*b*.

As described above, the X-ray tube 100 of this embodiment can promote radiation of heat by means of the heat-receiving cylinder 18*a* constituted of the heat-transfer enhancing member, and can secure the enhanced density of the magnetic flux by means of the main-body part 18*b* formed of the magnetic substance, the magnetic flux being generated by cooperation between the main-body part 18*b* and the stator coil (not shown). Accordingly, the X-ray tube 100 can prevent the temperature rise of the ball bearings 11 and 12, and can efficiently rotate the rotating cylinder 5.

It should be noted that in this embodiment, in the anode fixing body 18, the heat-receiving cylinder 18*a* may be formed of a magnetic substance, and the main-body part 18*b* may be constituted of a heat-transfer enhancing member.

Seventh Embodiment

Figure 15:
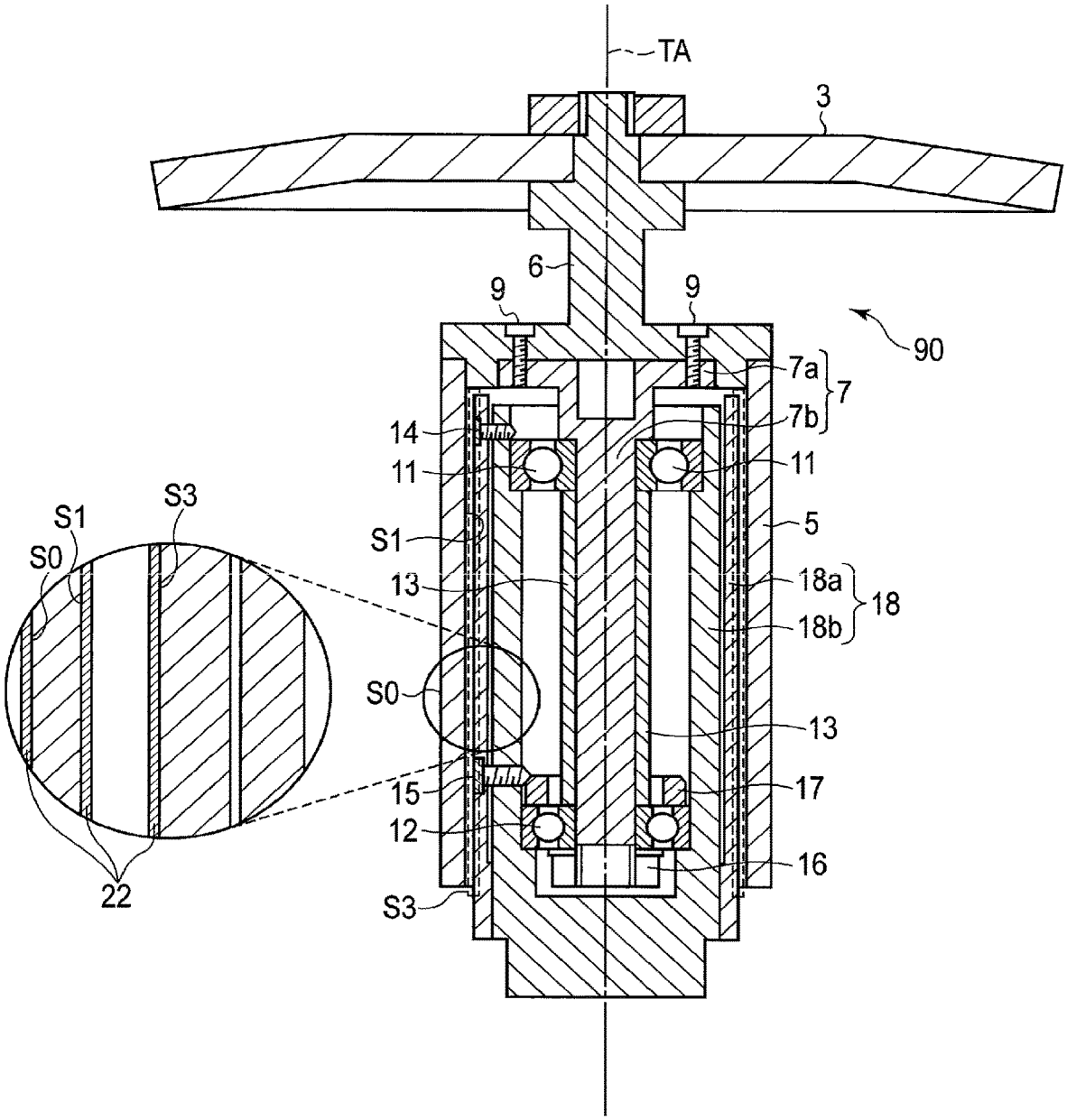
FIG. 15 is a vertical cross-sectional view showing an example of an anode structural body of an X-ray tube of a seventh embodiment.

FIG. 15 is a vertical cross-sectional view showing an example of an anode structural body 90 of an X-ray tube 100 of a seventh embodiment.

Although the anode structural body 90 according to the seventh embodiment has a configuration substantially equivalent to the anode structural body 90 of the sixth embodiment, the anode structural body 90 of this embodiment is provided with high-radiation films 22. As shown in FIG. 15, in the heat-receiving cylinder 18*a*, the surface of the outer circumferential part is designated as the outer circumferential surface S3. For example, the outer circumferential surface S3 is, similarly to the outer circumferential surface S2 of FIG. 8 showing the third embodiment, the region opposed to the inner circumferential surface S1 of the rotating cylinder 5.

The anode fixing body 18 of this embodiment is provided with a heat-receiving cylinder 18*a* constituted of a heat-transfer enhancing member, and a main-body part 18*b* formed of a magnetic substance.

In this embodiment, the high-radiation film 22 is formed on each of the outer circumferential surface S0, inner circumferential surface S1, and outer circumferential surface S3. It should be noted that it is sufficient if the high-radiation film 22 is formed on at least one of the inner circumferential surface S1 and the outer circumferential surface S3 in addition to the outer circumferential surface S0.

In this embodiment, when a high voltage is applied to the X-ray tube 100, part of the heat generated at the anode target 3 by being bombarded with an electron beam emitted from the cathode 2 is conducted to the rotating cylinder 5 through the supporting pillar 6. Although the heat conducted to the rotating cylinder 5 is radiated by the high-radiation film 22 formed on the outer circumferential surface S0 to the outside of the anode structural body 90, part of the heat is absorbed by the high-radiation film 22 formed on the outer circumferential surface S3 of the heat-receiving cylinder 18*a* constituted of the heat-transfer enhancing member. The heat absorbed by the heat-receiving cylinder 18*a* is conducted through the heat-receiving cylinder 18*a*, and is then conducted to the rear part of the main-body part 18*b* to which part of the heat-receiving cylinder 18*a* is fixed. The heat conducted to the rear part of the main-body part 18*b* is radiated to the outside of the anode structural body 90.

As described above, the diffusibility of the heat conducted from the anode target 3 through the supporting pillar 6 is enhanced by the high-radiation films 22 and the heat-receiving cylinder 18*a* constituted of the heat-transfer enhancing member, and hence the heat conducted to the ball bearings 11 and 12 is reduced. As a result, the temperature rise of the ball bearings 11 and 12 is prevented.

According to this embodiment, the high-radiation film 22 is formed on each of the outer circumferential surface S0 and the inner circumferential surface S1 of the rotating cylinder 5, and the outer circumferential surface S3 of the heat-receiving cylinder 18*a*. The heat conducted from the anode target 3 to the rotating cylinder 5 is radiated by, for example, the heat-receiving cylinder 18*a* and the high-radiation film 22 to the outside of the anode structural body 90 through the main-body part 18*b*.

As described above, the X-ray tube 100 of this embodiment can promote radiation of heat by means of the heat-receiving cylinder 18*a* constituted of the heat-transfer enhancing member and the high-radiation films 22, and can secure the enhanced density of the magnetic flux by means of the main-body part 18*b* formed of the magnetic substance, the magnetic flux being generated by cooperation between the main-body part 18*b* and the stator coil (not shown). Accordingly, the X-ray tube 100 can prevent the temperature rise of the ball bearings 11 and 12, and can efficiently rotate the rotating cylinder 5.

It should be noted that in this embodiment, in the anode fixing body 18, the heat-receiving cylinder 18*a* may be formed of a magnetic substance, and the main-body part 18*b* may be constituted of a heat-transfer enhancing member.

Eighth Embodiment

Figure 16:
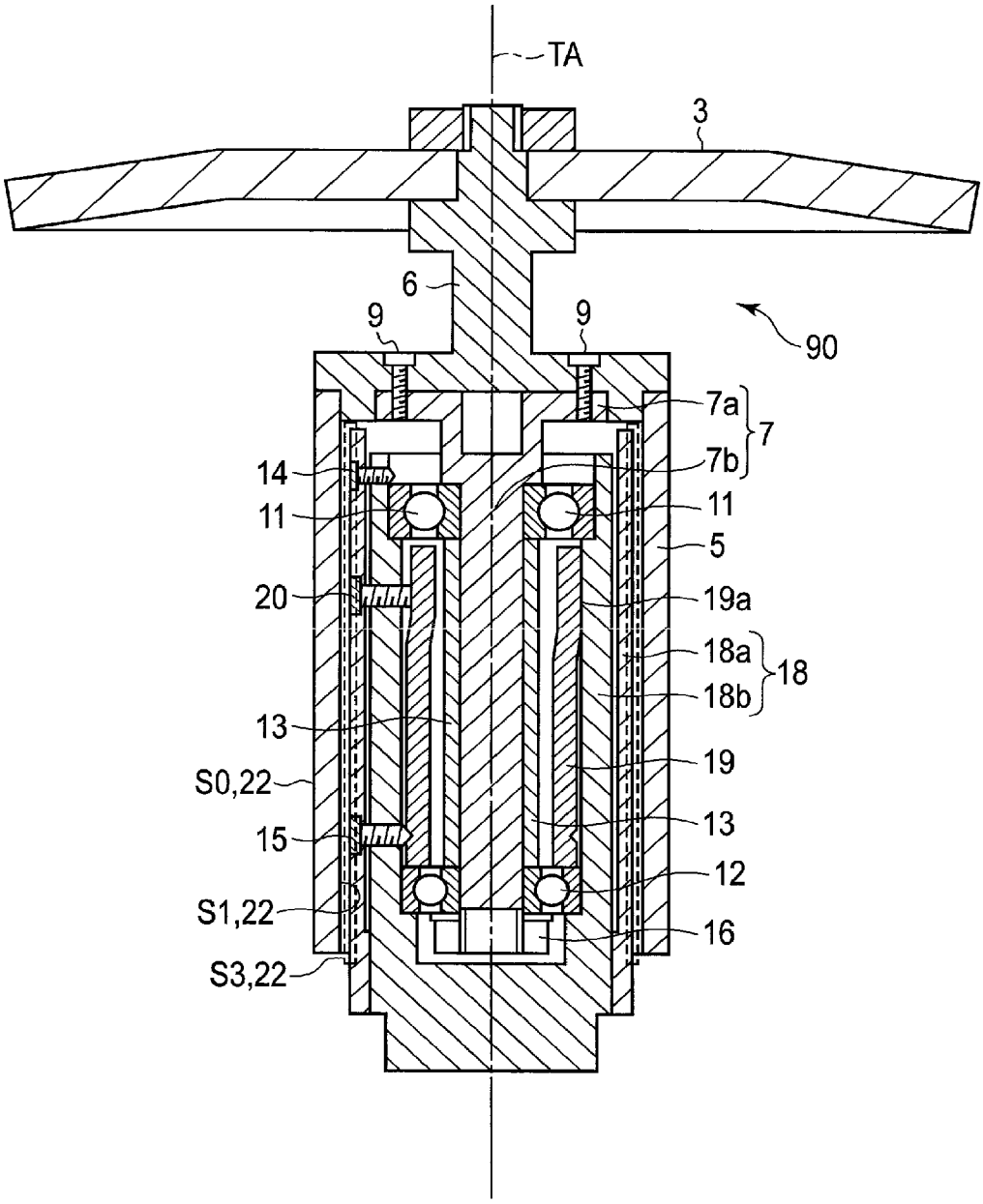
FIG. 16 is a vertical cross-sectional view showing an example of an anode structural body of an X-ray tube of an eighth embodiment.

FIG. 16 is a vertical cross-sectional view showing an example of an anode structural body 90 of an X-ray tube 100 of an eighth embodiment. In FIG. 16, although high-radiation films 22 are omitted, it is assumed that the high-radiation films 22 are formed on the surfaces for which the reference symbols of the high-radiation films are written together with those of the surfaces.

Although the anode structural body 90 according to the eighth embodiment has a configuration substantially equivalent to the anode structural body 90 of the aforementioned embodiment, the anode structural body 90 of this embodiment is further provided with an inner member 19.

The anode fixing body 18 of this embodiment is provided with a heat-receiving cylinder 18*a* constituted of a heat-transfer enhancing member, and a main-body part 18*b* formed of a magnetic substance.

The inner member 19 is a heat-transfer enhancing member. The inner member 19 is deformed by a set-screw to be screwed into a threaded hole part formed in the anode fixing body 18. A deformation contact part 19*a* is brought into contact with the inner circumferential part of the main-body part 18*b*.

In this embodiment, the X-ray tube 100 is provided with the inner member 19 constituted of the heat-transfer enhancing member. The inner member 19 is deformed by at least one set-screw 20, and a deformation contact part 19*a* is brought into contact with the inner circumferential part of the anode fixing body 18. At this time, part of the heat generated at the anode target 3 is conducted from the supporting pillar 6 to the rear end part of the anode fixing body 18 through the ball bearing 11, ball bearing 12, inner member 19 (deformation contact part 19*a*), and main-body part 18*b*, and is radiated to the outside of the anode structural body 90. The inner member 19 can relieve the thermal stress caused by heat by being thermally deformed. The heat conducted from the anode target 3 to the rotating cylinder 5 is conducted to the rear end part of the anode fixing body 18 through the heat-receiving cylinder 18*a* and the main-body part 18*b*, and is radiated to the outside of the anode structural body 90.

According to this embodiment, the X-ray tube 100 of this embodiment can promote radiation of heat by means of the heat-receiving cylinder 18*a* constituted of the heat-transfer enhancing member, inner member 19, and high-radiation films 22, and can secure the enhanced density of the magnetic flux by means of the main-body part 18*b* formed of the magnetic substance, the magnetic flux being generated by cooperation between the main-body part 18*b* and the stator coil (not shown). As a result, the X-ray tube 100 can prevent the temperature rise of the ball bearings 11 and 12, and can efficiently rotate the rotating cylinder 5.

It should be noted that in this embodiment, in the anode fixing body 18, the heat-receiving cylinder 18*a* may be formed of a magnetic substance, and the main-body part 18*b* may be constituted of a heat-transfer enhancing member.

In the aforementioned embodiment, although the ball bearings 11 and 12 include inner races, the inner races may be omitted, and bearing races may be provided on the rotating shaft 7. Further, in the aforementioned embodiment, although the two ball bearings 11 and 12 include outer races, the outer races may be omitted, and bearing races may be provided on the anode fixing body 18.

Further, as compared with the case where the high-radiation film 22 is formed on the inner circumferential surface S1 of the rotating cylinder 5, the case where the high-radiation film 22 is formed on the outer circumferential surface S2 of the anode fixing body 18 makes the manufacture easier. Instead of forming the high-radiation films 22 on the inner circumferential surface S1 of the rotating cylinder 5, outer circumferential surface S2 of the anode fixing body 18, and outer circumferential surface S3 of the heat-receiving cylinder 18*a*, it is also possible to subject these surfaces to surface roughening to thereby enhance the radiation factor (emissivity).

The present invention is not limited to the embodiments described above but the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

What is claimed is:

1. A rotating anode X-ray tube comprising:

a rotating cylinder to which an anode target is fixed;

a rotating shaft coaxially fixed to the inside of the rotating cylinder;

an anode fixing body arranged between the rotating cylinder and the rotating shaft, extending in the axial direction, and constituted of one of a magnetic substance member formed of a magnetic substance and a heat-transfer enhancing member having a heat conductivity which is higher than surrounding members;

ball bearings provided between the anode fixing body and the rotating shaft; and an inner member arranged between the anode fixing body and the rotating shaft, connected to the anode fixing body by means of a connecting member, and constituted of the other one of the magnetic substance member and the heat-transfer enhancing member, the inner member being different from the member constituting the anode fixing body.

2. The rotating anode X-ray tube of claim 1, wherein the inner member is the heat-transfer enhancing member, and the anode fixing body is the magnetic substance member.

3. The rotating anode X-ray tube of claim 2, wherein in the inner member, at least one pressing deformation part, deformed by being pressed by at least one set-screw to be screwed into at least one threaded hole part provided in the anode fixing body, is brought into contact with the anode fixing body.

4. The rotating anode X-ray tube of claim 2, wherein in the inner member, at least one drawing deformation part, deformed by being drawn by at least one drawing thread to be inserted into at least one hole part provided in the anode fixing body, is brought into contact with the anode fixing body.

5. The rotating anode X-ray tube of claim 3 wherein in the inner member, at least one threaded hole part or a hole part is formed in the vicinity of the ball bearing.

6. The rotating anode X-ray tube of claim 2, wherein the heat-transfer enhancing member is formed of pure copper or a copper alloy.

7. The rotating anode X-ray tube of claim 1, wherein the inner member is the magnetic substance member, and the anode fixing body is the heat-transfer enhancing member.

8. The rotating anode X-ray tube of claim 7, wherein the heat-transfer enhancing member is formed of pure copper, a copper alloy, oxide-strengthened copper or a copper-tungsten alloy.

9. A rotating anode X-ray tube comprising:

an anode target to be bombarded with electrons;

a rotating cylinder a bottom part of which is connected to the anode target;

a rotating shaft coaxially connected to the anode target inside the rotating cylinder;

an anode fixing body arranged between the rotating cylinder and the rotating shaft, and extending in the axial direction;

ball bearings rotatably provided between the anode fixing body and the rotating shaft;

a high-radiation film provided on at least one of an inner circumferential part of the rotating cylinder and an outer circumferential part of the anode fixing body, and configured to promote radiation of heat; and a fixed cylinder provided between the rotating shaft and the anode fixing body, and connected to the anode fixing body by means of a connecting member in such a manner that the fixed cylinder is thermally deformable.

10. The rotating anode X-ray tube of claim 9, wherein the high-radiation film is constituted of a material a principal ingredient of which is at least one of triiron tetraoxide, aluminum oxide, and titanium oxide.

11. The rotating anode X-ray tube of claim 9, wherein the anode fixing body is constituted of one of a magnetic substance member formed of a magnetic substance, and a heat-transfer enhancing member having a thermal conductivity which is higher than surrounding members, and the fixed cylinder is connected to the anode fixing body by means of a connecting member, and is constituted of the other one of the magnetic substance member and the heat-transfer enhancing member, the inner member being different from the member constituting the anode fixing body.

12. The rotating anode X-ray tube of claim 11, wherein the fixed cylinder is the heat-transfer enhancing member, and the anode fixing body is the magnetic substance member.

13. The rotating anode X-ray tube of claim 12, wherein the connecting member is a set-screw, and in the fixed cylinder, a deformation part, formed by being pressed by the connecting member, is in contact with the anode fixing body.

14. The rotating anode X-ray tube of claim 12, wherein the connecting member is a drawing thread, and in the fixed cylinder, a deformation part, formed by being drawn by the connecting member, is in contact with the anode fixing body.

15. The rotating anode X-ray tube of claim 13, wherein the fixed cylinder includes the deformation part at a part thereof in the vicinity of the ball bearing.

16. The rotating anode X-ray tube of claim 11, wherein the heat-transfer enhancing member is formed of pure copper or a copper alloy.

17. The rotating anode X-ray tube of claim 11, wherein the fixed cylinder is the magnetic substance member, and the anode fixing body is the heat-transfer enhancing member.

18. The rotating anode X-ray tube of claim 17, wherein the heat-transfer enhancing member is formed of pure copper, a copper alloy, oxide-strengthened copper or a copper-tungsten alloy.

19. A rotating anode X-ray tube comprising:

an anode target to be bombarded with electrons;

a rotating cylinder a bottom part of which is connected to the anode target;

a rotating shaft coaxially connected to the anode target inside the rotating cylinder;

an anode fixing body arranged between the rotating cylinder and the rotating shaft, and extending in the axial direction;

ball bearings rotatably provided between the anode fixing body and the rotating shaft;

a heat-transfer cylinder provided between the rotating cylinder and the anode fixing body, and fixed to the anode fixing body at a fixing part farther from the anode target; and a fixed cylinder provided between the rotating shall and the anode fixing body, and connected to the anode fixing body by means of a connecting member in such a manner that the fixed cylinder is thermally deformable.

20. The rotating anode X-ray tube of claim 19, further comprising a high-radiation film provided on at least one of an inner circumferential part of the rotating cylinder, and an outer circumferential part of the heat-transfer cylinder, and said high-radiation film configured to promote radiation of heat.

21. The rotating anode X-ray tube of claim 19, wherein the heat-transfer cylinder includes the fixing part at a position farther from the anode target than the ball bearings in the axial direction.

* * * * *